US012716684B2

(12) United States Patent
Heighes

(10) Patent No.: US 12,716,684 B2
(45) Date of Patent: Aug. 25, 2026

(54) SLIDER MECHANISM FOR COLLAPSIBLE FIREARM STOCK

(71) Applicant: Magpul Industries Corp., Austin, TX (US)

(72) Inventor: Tyler Heighes, Fort Collins, CO (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 19/015,160

(22) Filed: Jan. 9, 2025

(65) Prior Publication Data

US 2025/0231004 A1 Jul. 17, 2025

Related U.S. Application Data

(60) Provisional application No. 63/620,294, filed on Jan. 12, 2024.

(51) Int. Cl.
*F41C 23/04* (2006.01)

(52) U.S. Cl.
CPC ..... *F41C 23/04* (2013.01)

(58) Field of Classification Search
CPC ..... F41C 23/00; F41C 23/04; F41C 23/14
See application file for complete search history.

(56) References Cited

U.S. PATENT DOCUMENTS 7,162,822 B1 * 1/2007 Heayn ..... F41C 23/04 42/71.01
7,762,018 B1 * 7/2010 Fitzpatrick ..... F41C 23/22 42/73
7,823,313 B2 11/2010 Faifer
8,806,791 B2 8/2014 Cottle
9,261,324 B1 * 2/2016 Liang ..... F41C 23/04
9,546,836 B2 1/2017 Cottle et al.
(Continued)

FOREIGN PATENT DOCUMENTS

EP 4425092 A1 * 9/2024 ..... F41C 23/14
KR 102141664 B1 * 8/2020 ..... F41C 23/14
WO WO-2024206558 A2 * 10/2024 ..... F41C 23/04

OTHER PUBLICATIONS

Hrachya H., "[Shot 2023] Geissele GFR Maritime RECCE and Stratomatch 6mm ARC Rifles", thefirearmblog.com, 9 pages, Jan. 30, 2023.

(Continued)

*Primary Examiner* — Gabriel J. Klein
(74) *Attorney, Agent, or Firm* — NOD Law PC

(57) ABSTRACT

A device may include a proximal end and a distal end, an internal cavity of the device is defined between the proximal end and the distal end. The device may include a slider panel defining a channel and a biasing mechanism disposed in the internal cavity, the biasing mechanism configured to bias the slider panel. The device may include a lock pin disposed in the internal cavity and configured to contact the biasing mechanism. The device may include a release pin extending through the lock pin, wherein: an end portion of the release pin extends into the channel, the release pin is configured to travel along a path defined by the channel in response to a movement of the slider panel; and the release pin is configured to cause the lock pin to transition from a first position to a second position in response to the movement.

20 Claims, 12 Drawing Sheets

(56) References Cited

U.S. PATENT DOCUMENTS

| | | | | |
|---|---|---|---|---|
| 9,551,549 | B1 * | 1/2017 | Chvala | F41C 7/00 |
| 9,612,083 | B2 | 4/2017 | Cottle et al. | |
| 9,746,281 | B2 * | 8/2017 | Wilson | F41C 23/14 |
| 9,970,724 | B1 * | 5/2018 | Acker | F41A 17/46 |
| 10,139,195 | B2 | 11/2018 | Olsen | |
| 10,260,837 | B1 | 4/2019 | McGinty | |
| 11,385,009 | B2 * | 7/2022 | Hudson, III | F41A 17/46 |
| 11,592,263 | B2 | 2/2023 | Vanek | |
| 11,609,065 | B2 | 3/2023 | Raymond | |
| 11,703,300 | B1 * | 7/2023 | Chang | F41B 5/123 124/25 |
| 2010/0242328 | A1 * | 9/2010 | Faifer | F41C 23/06 42/1.06 |
| 2013/0097911 | A1 * | 4/2013 | Larue | F41C 23/04 42/73 |
| 2013/0180148 | A1 * | 7/2013 | Rogers | F41C 23/04 42/73 |
| 2018/0080736 | A1 * | 3/2018 | Olsen | F41C 23/14 |
| 2020/0182586 | A1 * | 6/2020 | Zhang | F41C 23/20 |
| 2020/0240743 | A1 * | 7/2020 | Cahill | F41C 23/14 |

OTHER PUBLICATIONS

"UBR® GEN2 Collapsible Stock", Available online at : https://magpul.com/ubr-gen2-collapsible-stock.html?mp_global_color=118, 8 pages.

"LaRue Tactical RAT™ Stock", Available online at: https://www.larue.com/products/larue-tactical-rat-stock/, 1 page.

"Instagram—taskernetwork", Available online at: https://www.instagram.com/p/CY76-yHLMEO/?igshid=MzRIODBINWFIZA%3D%3D, 3 pages.

"Shot Show 2022—Geissele", Available online at: https://www.youtube.com/watch?v=tDL0ObYijPw&t=66s, 2022, 2 pages.

"The Geissele GFR 6mm ARC RECCE Rifle", Available online at: https://www.youtube.com/watch?v=Bex0jT-VJhQ&t=436s, Jan. 26, 2023, 2 pages.

* cited by examiner

SLIDER MECHANISM FOR COLLAPSIBLE FIREARM STOCK

CROSS-REFERENCE TO RELATED APPLICATIONS

The present application claims priority to and the benefit of U.S. Provisional Patent Application No. 63/620,294, filed Jan. 12, 2024, which is incorporated herein by reference in its entirety.

FIELD

The described examples relate generally to firearm buttstocks. In particular, but not by way of limitation, the present disclosure relates to systems, methods, and apparatuses for a buttstock for improved adjustment, removal, and installation that includes a user interface that may promote more efficient shouldered length-of-pull adjustments.

BACKGROUND

Collapsible firearm buttstocks provide various advantages beyond merely reducing overall length for storage or transport. Importantly, multi-position collapsible stocks offer improved ergonomic interface for accommodating users of various sizes, for adapting to equipment like cold-weather gear or body armor which affect length-of-pull, or for adjusting to various firing positions, such as standing, prone, and the like. While there are many examples of collapsible stocks, some existing products feature a first pin that interfaces with a receiver tube, a second pin that passes through the first pin, and a device that allows the user to adjust the stock. This arrangement typically works well but does have a few drawbacks.

First, due to a pivoting operation of the device, it can be challenging for a user to find the correct hand placement to adjust the stock, especially while the firearm remains shouldered. This adjustment mechanism was originally intended to be used during setup when removing the firearm from storage, e.g., in a fully collapsed position, and then extending the stock to the ideal length for the user. For example, the user is able to hold the stock over the top and manipulate the device with their fingers while the firearm is unshouldered. However, the user is inhibited from adjusting the length-of-pull with the firearm in an expanded or "in-use" position, especially with the firearm in a shouldered position. For example, the user must hold the stock from underneath and manipulate the device with a thumb or web of the hand which may induce painful pinching or an improperly leveraged operation, e.g., if the user holds too close to the pivot axis. To avoid these effects, many users may leave the stock position alone and work around an unoptimized length-of-pull, which may reduce effectiveness, or alternatively may remove the firearm from the shouldered position to adjust the stock, which may reduce situational awareness.

Further still, length-of-pull adjustments on collapsible stocks are typically controlled by means of a translating pin which interfaces with a receiver tube. Additionally, a secondary mechanism can be directly operated by the user, which in turn controls the movement of the pin. This secondary mechanism can be depressed on one end, pivoting about a central fulcrum and extending the pin away from the receiver tube thereby permitting a length-of-pull adjustment. Further, this style of stock typically leads to the use of a vertical secondary mechanism, either inside or outside the pin, leading to a geometry that is taller than desired, e.g., not compact. Additionally, when a user attempts to remove this style of stock, the user must manually override the secondary mechanism by hand, pulling the pin downward until the pin fully clears the buffer tube. This can be an uncomfortable movement and difficult, especially if a user is operating the mechanism wearing gloves.

The information included in this Background section of the specification is included for technical reference purposes only and is not to be regarded subject matter by which the scope of the present disclosure is to be bound.

SUMMARY

In at least one example of the present disclosure, the techniques described herein relate to a buttstock including: a proximal end configured to contact a user object and a distal end configured to slidably couple with a receiver extension, wherein an internal cavity of the buttstock is defined between the proximal end and the distal end; a slider panel defining a channel; a biasing mechanism disposed in the internal cavity, the biasing mechanism configured to bias the slider panel toward the distal end of the buttstock; a lock pin disposed in the internal cavity and configured to contact the biasing mechanism, wherein a longitudinal axis of the lock pin is substantially orthogonal to a longitudinal axis of the biasing mechanism; and a release pin extending through the lock pin, wherein a longitudinal axis of the release pin is substantially orthogonal to the longitudinal axis of the lock pin and substantially orthogonal to the longitudinal axis of the biasing mechanism; wherein: an end portion of the release pin extends into the channel; the release pin is configured to travel along a path defined by the channel in response to a movement of the slider panel; and the release pin is configured to cause the lock pin to transition from a first position to a second position in response to the movement.

In one example, the slider panel is a first slider panel, the buttstock further including: a second slider panel coupled with the first slider panel by a fastener extending through the internal cavity of the buttstock, wherein the first slider panel and the second slider panel are configured to travel along a horizontal track defined by a body of the buttstock. In one example, the slider panel includes an interface between the proximal end and the distal end of the buttstock; and the movement of the slider panel is caused by user engagement with the interface. In one example, the movement of the slider panel is toward the proximal end of the buttstock; with the lock pin in the first position, the release pin extends into an upper portion of the channel; and with the lock pin in the second position, the release pin extends into a lower portion of the channel. In one example, with the lock pin in the first position, a portion of the lock pin is configured to extend into a pocket defined by the receiver extension; with the lock pin in the second position, the portion of the lock pin is configured to not extend into the pocket of the receiver extension; and with the lock pin in the second position, the buttstock is configured to slide along a length of the receiver extension. In one example, the movement of the slider panel is caused by the biasing mechanism; the movement of the slider panel is toward the distal end of the buttstock; with the lock pin in the first position, the release pin extends into a lower portion of the channel; and with the lock pin in the second position, the release pin extends into an upper portion of the channel. In one example, with the lock pin in the first position, a portion of the lock pin is configured to not extend into a pocket defined by the receiver extension; with the lock pin in the second position, the portion of the lock pin is configured to extend into the pocket of the receiver extension; and with the lock pin in the second position, the buttstock is inhibited from sliding along a length of the receiver extension. In one example, the buttstock further includes a lever configured to inhibit the movement of the slider panel, wherein the movement is toward the proximal end of the buttstock. In one example, the buttstock further includes: a lever configured to transition between a locked position and an unlocked position, wherein with the lever in the locked position, the lever is configured to inhibit the movement of the slider panel and lock a portion of the lock pin in a pocket defined by the receiver extension; and an icon configured to signal whether the lever is in the locked position or the unlocked position.

In at least one example of the present disclosure, the techniques described herein relate to a stock assembly including: a stock body defining an interior cavity between a proximal end and a distal end of the stock body; and a slider assembly including: a first panel having an interior surface and an exterior surface, the interior surface of the first panel partially defining the interior cavity and defining a first channel; a second panel having an interior surface and an exterior surface, the interior surface of the second panel partially defining the interior cavity and defining a second channel; a fastener extending through the interior cavity and coupling the first panel and the second panel together, wherein the first panel and the second panel are each configured to move together along a track defined by the stock body; a lock pin disposed in the internal cavity; and a release pin extending through the lock pin and having a first end portion extending into the first channel and a second end portion extending into the second channel; wherein: the release pin is configured to travel along a fixed path defined by the first channel and the second channel in response to a movement of the first panel and the second panel along the track; and the release pin is configured to cause the lock pin to transition from a first position to a second position in response to the movement.

In one example, the stock assembly further includes a biasing mechanism disposed in the internal cavity, the biasing mechanism configured to contact the lock pin and configured to bias the first panel and the second panel toward the distal end of the stock body. In one example, the movement of the first panel and the second panel is caused by the biasing mechanism; the movement of the first panel and the second panel is toward the distal end of the stock body; with the lock pin in the first position, the first end portion of the release pin extends into a lower portion of the first channel and the second end portion of the release pin extends into a lower portion of the second channel; and with the lock pin in the second position, the first end portion of the release pin extends into an upper portion of the first channel and the second end portion of the release pin extends into an upper portion of the second channel. In one example, with the lock pin in the second position, a portion of the lock pin is configured to extend into a pocket of a receiver extension and inhibit the stock body from sliding along a length of the receiver extension. In one example, the first panel and the second panel each include an interface disposed on the exterior surfaces of the first panel and the second panel, respectively; the movement of the first panel and the second panel is caused by user engagement with at least one of the interface of the first panel or the interface of the second panel; the movement of the first panel and the second panel is toward the proximal end of the stock body; with the lock pin in the first position, the first end portion of the release pin extends into an upper portion of the first channel and the second end portion of the release pin extends into an upper portion of the second channel; and with the lock pin in the second position, the first end portion of the release pin extends into a lower portion of the first channel and the second end portion of the release pin extends into a lower portion of the second channel. In one example, with the lock pin in the first position, a portion of the lock pin is configured to extend into a pocket defined by the receiver extension; with the lock pin in the second position, the portion of the lock pin is configured to not extend into the pocket of the receiver extension; and with the lock pin in the second position, the stock body is configured to slide along a length of the receiver extension. In one example, the first panel and the second panel each include an interface disposed on the exterior surfaces of the first panel and the second panel, respectively; and the interfaces each extend outward from the exterior surfaces of the first panel and the second panel. In one example, the stock assembly further includes a lever configured to inhibit the movement of the first panel and the second panel, wherein the movement is toward the proximal end of the stock body.

In at least one example of the present disclosure, the techniques described herein relate to a buttstock including: a slider panel defining a channel; a biasing mechanism disposed in an internal cavity defined by the buttstock, the biasing mechanism configured to bias the slider panel toward a distal end of the buttstock; a lock pin disposed in the internal cavity; a release pin affixed within the lock pin and having an end portion extending into the channel, wherein the release pin is configured to translate longitudinal motion of the slider panel to perpendicular motion of the lock pin; and a lever configured to transition between a first state and a second state; wherein: with the lever in the first state, the lever is arranged to inhibit retraction of the slider panel toward a proximal end of the buttstock; and with the lever in the second state, the lever is arranged to permit retraction of the slider panel toward the proximal end of the buttstock.

In one example, the lever includes an integral spring and a detent. In one example, the integral spring and the detent are formed from a cantilevered arm configured to interface with an interior surface of the buttstock.

In addition to the exemplary aspects and embodiments described in this Summary, further aspects and embodiments will become apparent by reference to the drawings and by study of the following description. This Summary is not intended to identify key features or essential features of the claimed subject matter, nor is it intended to be used to limit the scope of the claimed subject matter.

BRIEF DESCRIPTION OF THE DRAWINGS

The disclosure will be readily understood by the following detailed description in conjunction with the accompanying drawings, wherein like reference numerals designate like structural elements, and in which.

Figure 1:
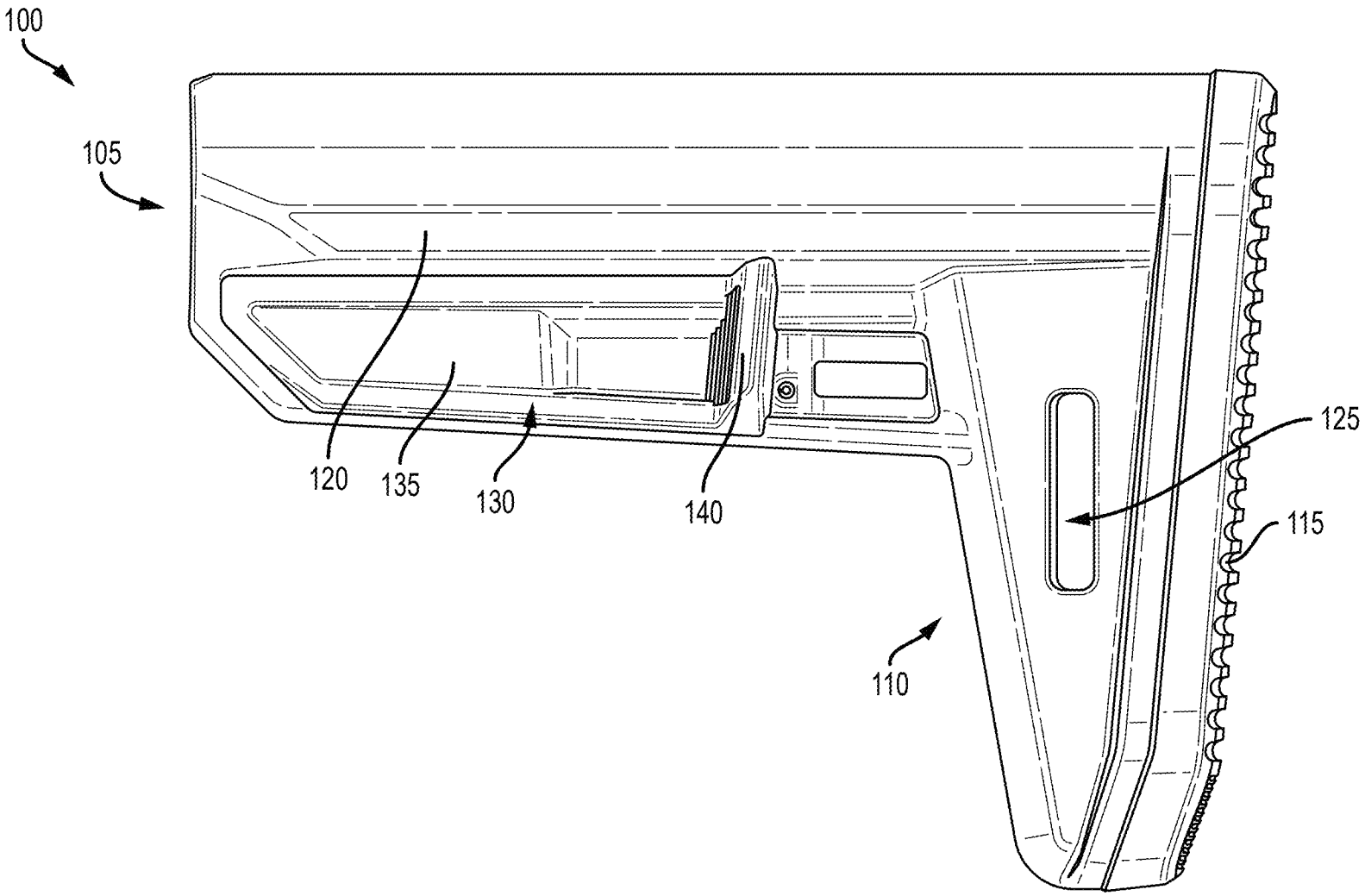
FIG. 1 depicts a view of an example of a stock assembly.

This Brief Description of the Drawings is not intended to identify essential features of the claimed subject matter, nor is it intended to be used to limit the scope of the claimed subject matter. A more extensive presentation of features, details, utilities, and advantages of the present disclosure is provided in the following written description of various embodiments of the claimed subject matter and illustrated in the accompanying drawings.

DETAILED DESCRIPTION

The described examples relate generally to firearm buttstocks. In particular, but not by way of limitation, the present disclosure relates to systems, methods, and apparatuses for a buttstock for improved adjustment, removal, and installation that includes a user interface that may promote more efficient length-of-pull (LOP) and shouldered LOP adjustments.

The word "herein" includes the descriptions provided throughout this specification, including the Field, Background, Summary, Brief Description of the Drawings, Detailed Description, Claims, and Abstract. The word "exemplary" is used herein to mean "serving as an example, instance, or illustration." Any embodiment described herein as "exemplary" is not necessarily to be construed as preferred or advantageous over other embodiments. The terms "about" and "substantially" herein are to be construed as including +/−10%, unless stated otherwise. For example, "substantially orthogonal" means any degree from 81 degrees through 99 degrees. Every range of values (of the form, "from about a to about b," or, equivalently, "from approximately a to b," or, equivalently, "from approximately a-b" or, equivalently, "greater than about a and less than about b", for example) disclosed herein is to be understood to set forth every number and range encompassed within the broader range of values.

The flowcharts and block diagrams in the following Figures illustrate the functionality and operation of possible implementations of a collapsible firearm stock according to various embodiments of the present disclosure. It should be noted that, in some alternative implementations, the functions noted in each block or figure may occur out of the order noted in the figures. For example, two blocks or figures shown in succession may, in fact, be executed substantially concurrently, or the blocks or figure may sometimes be executed in the reverse order, depending upon the functionality involved.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/". Thus, for example, the phrase "A, B, C, and/or D" includes A, B, C, and D individually, but also includes any and all combinations and subcombinations of A, B, C, and D.

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Embodiments of the disclosure are described herein with reference to schematic illustrations of exemplary embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Other examples and implementations are within the scope and spirit of the disclosure and appended claims. Thus, the descriptions of the specific examples described herein are presented for purposes of illustration and description. They are not targeted to be exhaustive or to limit the examples to the precise forms disclosed. It will be apparent to one of ordinary skill in the art that many modifications and variations are possible in view of the above teachings.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Prior to describing the embodiments in detail, some terms to be understood in this document shall first be defined. For the purpose of this document, the terms "top", "bottom", "vertical", and "horizontal" shall be understood to reference orientation of components relative to a firearm that is held such that the barrel is substantially horizontal to ground, and rotated such that a firing grip is not rotated to a left or a right when viewed from directly behind the firearm. For example, in FIG. 1, the stock assembly 100 includes a relatively smooth top that runs almost a full length of the stock assembly 100. The term "distal" shall be understood to reference those components or a direction approaching the end of a firearm from which rounds leave when fired, or furthest from a butt pad of a firearm. The term "proximal" shall be understood to reference those components or a direction opposing the distal end. For example, in FIG. 1, the stock assembly 100 is attached at a proximal end of the firearm via a distal end of the stock assembly 100 and a proximal end of the stock assembly 100 includes the butt pad 115. For example, the term "proximal" may refer to an object, such as a first component of the stock assembly 100, that is closer to a user in an operational orientation than another object, such as a second component of the stock assembly 100. In another example, the term "proximal" may refer to a direction towards a user in an operational orientation.

FIG. 1 depicts an example of a stock assembly 100. The stock assembly 100 and the elements of the stock assembly 100 described herein may enable a user or manufacturer to more efficiently align and attach the stock assembly 100 and/or components thereof to a firearm and/or components thereof, as compared to traditional means for attaching a stock to a firearm. Since the stock assembly 100 may enable attachment to a firearm and/or components thereof, the stock assembly 100 and/or components thereof may be referred to as a mounting system. The stock assembly 100 may also be referred to as a stock, collapsible stock, a buttstock, or the like, e.g., which may be attached to a firearm and/or components thereof.

The stock assembly 100 and the elements of the stock assembly 100 described herein may also enable more efficient LOP adjustments or shouldered LOP adjustments, as compared to traditional means for adjusting LOP. For example, the stock assembly 100 includes elements that permit a user to make LOP adjustments in various positions, e.g., a standing or prone position, and the like. Additionally, the elements of the stock assembly 100 are arranged in a more compact manner, compared to traditional stocks with adjustable LOP, which contributes to reduced weight compared to traditional stocks. For example, the weight of the stock assembly 100 may be greater than or equal to about 5 ounces and less than or equal to about 11 ounces. For example, the stock assembly 100 may be about 8 ounces.

The stock assembly 100 may include a lower stock assembly 110 and an outer stock body 120. The lower stock assembly 110 may include a longitudinal axis substantially orthogonal or oblique to a longitudinal axis of the outer stock body 120. The lower stock assembly 110 may also include a longitudinal axis substantially parallel to the longitudinal axis of the outer stock body 120. For example, the lower stock assembly 110 may have a corner shape and the outer stock body 120 may have a substantially straight shape.

Figure 2:
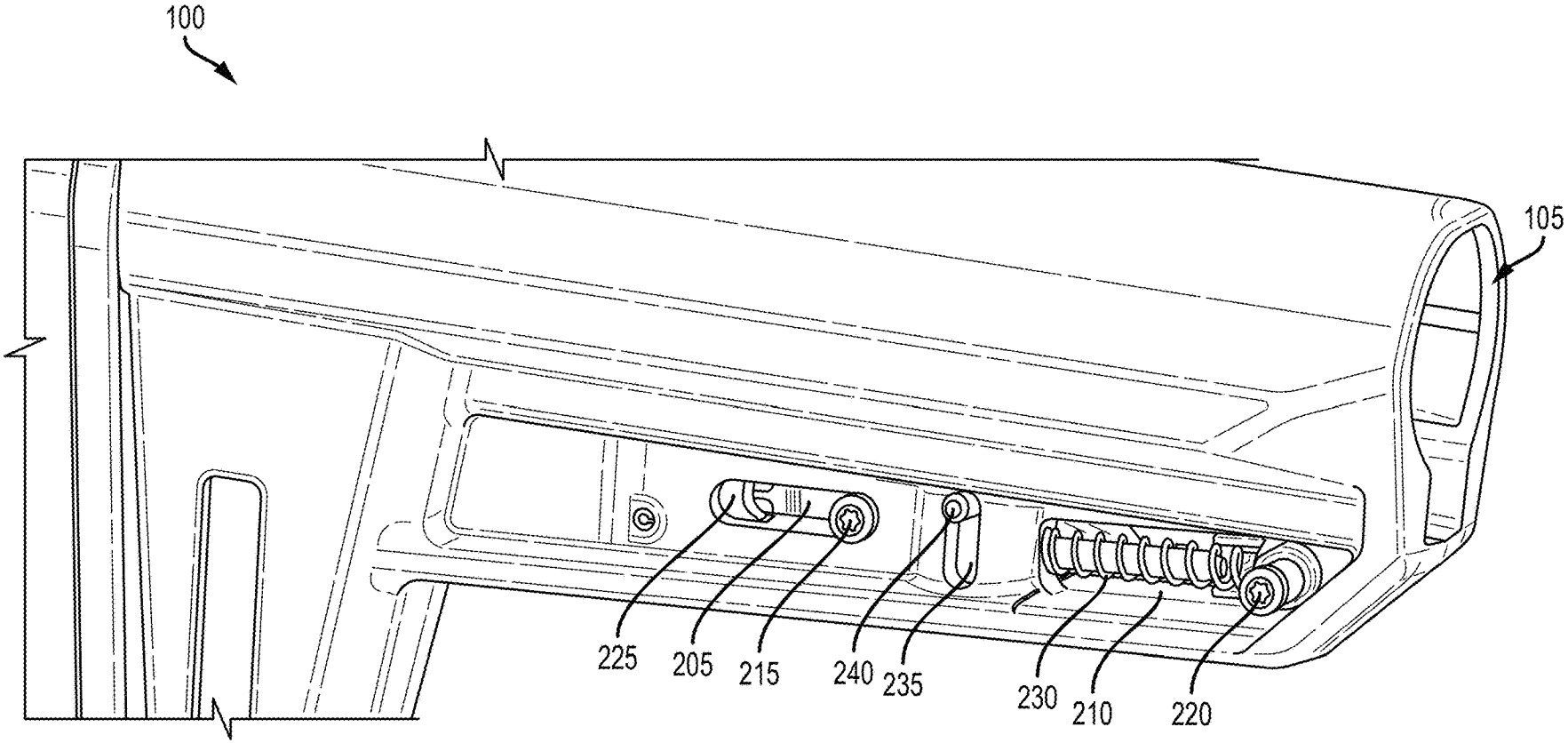
FIG. 2 depicts a partially exploded view of an example of a stock assembly.

The stock assembly 100 may include a receiver interface area 105. The receiver interface area 105 may be arranged or located at a distal end of the stock assembly 100. For example, the receiver interface area 105 may face away from a user in an operational orientation of the stock assembly 100. The distal end of the stock assembly 100 may slidably couple with a receiver extension or buffer tube 710, e.g., as depicted in FIG. 7B among others. For example, the stock assembly 100 may be mounted to the receiver extension 710 such that motion of the stock assembly 100 is restricted in certain directions, e.g., upward and downward, but permitted along the receiver extension 710 e.g., forward and rearward or along a longitudinal axis of the receiver extension. For example, the receiver interface area 105 may receive a receiver extension or buffer tube, e.g., as depicted in FIG. 7B among others. For example, the receiver interface area 105 may be or may lead to a cavity defined by the stock assembly 100, e.g., by the outer stock body 120 of the stock assembly 100. In this way, the cavity may be an internal or interior cavity of the stock assembly 100, which may be defined between the proximal end and the distal end of the stock assembly 100. The receiver interface area 105 and/or cavity may be sized to correspond to the receiver extension. For example, the receiver extension may be a cylindrical tube, and the cavity may have a corresponding cylindrical shape. In some examples, the receiver extension may include an extension and the receiver interface area 105 and/or cavity may have a corresponding shape, such as a key shape as depicted in FIG. 2 among others.

The stock assembly 100 may include a butt pad 115. The butt pad 115 may be or may include flexible materials, such as rubber, soft polymer, foam, and the like. In some examples, the butt pad 115 may be or may include hard materials, such as steel, Polyethylene Terephthalate, and the like. The butt pad 115 may be arranged or located at a proximal end of the stock assembly 100. For example, the proximal end of the stock assembly 100 may contact a user object, such as a shoulder region of a user, and the butt pad 115 may be received by the user object, e.g., in an operational orientation of the stock assembly 100. The butt pad 115 may include angled edges, which may correspond to or align with the shape of the user object. The angled edges may promote comfortable positioning of the stock assembly 100, e.g., in an operational orientation, and thus may enable more efficient LOP adjustments and shoulder transitions of the stock assembly 100.

The butt pad 115 may have a thickness greater than or equal to about 0.4 inches and less than or equal to about 2.0 inches. For example, the thickness of the butt pad 115 may may be about 0.7 inches. The thickness of the butt pad 115 may contribute to additional LOP. For example, with the stock assembly 100 coupled with a firearm, the thickness of the butt pad 115 increases the overall length of the firearm 115 and stock assembly 100 combination. The butt pad 115 may be integral to the stock assembly 100 or may removably couple with the stock assembly 100, e.g., the butt pad 115 may be removable. For example, the stock assembly 100 may include a butt pad interface configured to couple with the butt pad 115.

Figure 8A:
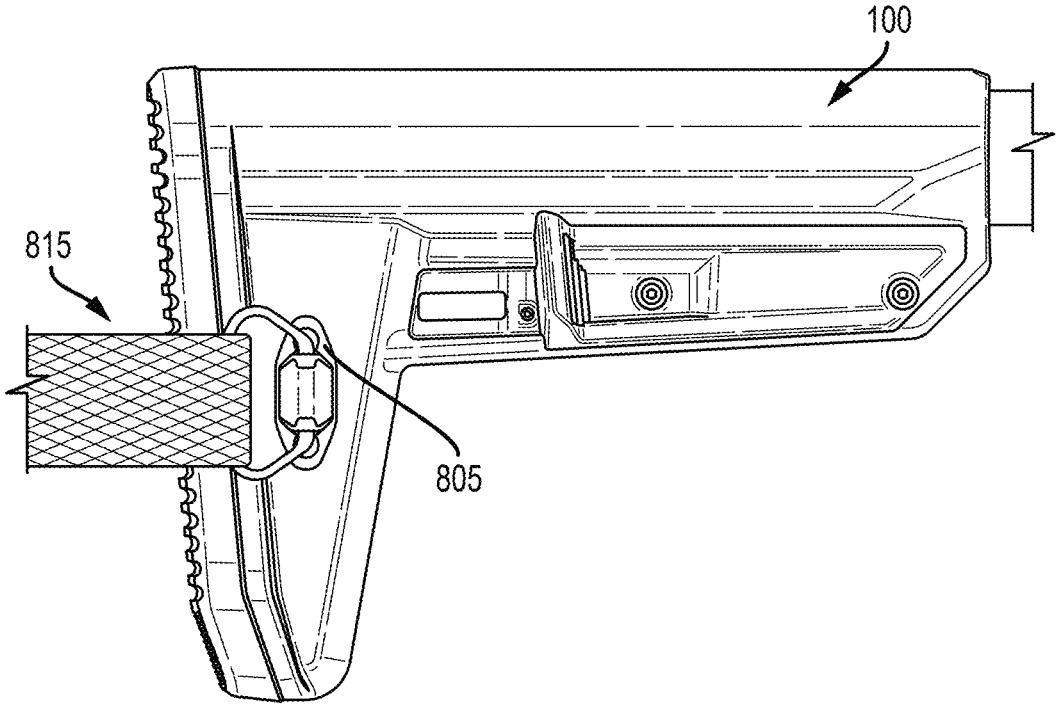
FIG. 8A depicts a view of an example of a sling coupled with a stock assembly.
Figure 8B:
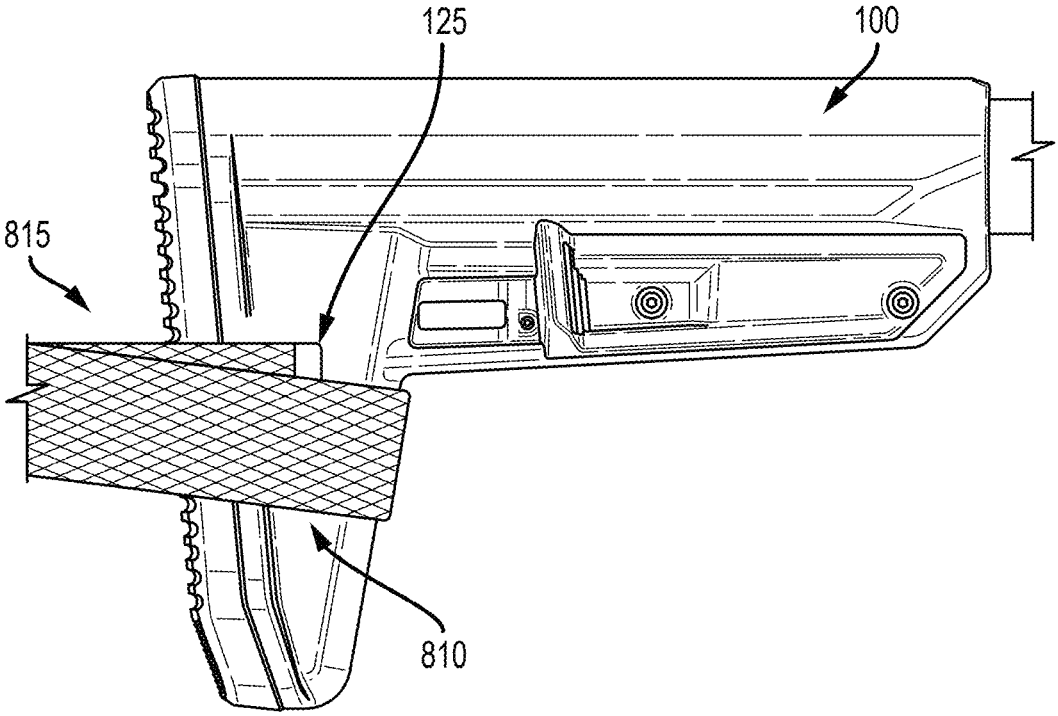
FIG. 8B depicts a view of an example of a sling coupled with a stock assembly.

The stock assembly 100, e.g., the lower stock assembly 110, may define a slot 125. The slot 125 may be a hole extending through the lower stock assembly 110. For example, the slot 125 may extend through a thickness of the lower stock assembly 110. The slot 125 may be defined near the proximal end of the stock assembly 100. For example, the slot 125 may be arranged or located between the receiver interface area 105 and the butt pad 115. The slot 125 may receive a firearm accessory, such as a sling 815 or a sling mount 805, as depicted in FIGS. 8A-B among others. The slot 125 may have an elongated shape, such as a rectangular shape that may include rounded corners. The elongated shape of the slot 125 may enable a more efficient attachment of a firearm accessory, for example, since the elongated shape may correspond to the shape or width of the firearm accessory.

The stock assembly 100 may include a slider assembly 130. The slider assembly 130 may enable a user to adjust the distance of the stock assembly 100 from a firearm, so that with the stock assembly 100 coupled with the firearm, the firearm and stock assembly 100 combination can be adjusted for different users or different circumstances. The stock assembly 100 may moveably interface with the receiver extension or buffer tube, e.g., as depicted in FIGS. 7A-7F among others, via the slider assembly 130. Thus, the slider assembly 130 may enable or promote LOP adjustments of the firearm.

The stock assembly 100, e.g., the slider assembly 130, may include at least one panel 135. The panel 135 may move or slide along a horizontal track 740 defined by the body of the stock assembly 100, e.g., as depicted in FIGS. 7A-7F among others. The panel 135 may have an interior surface and an exterior surface. The interior surface of the panel 135 may partially define the interior cavity of the stock assembly 100.

Figure 6A:
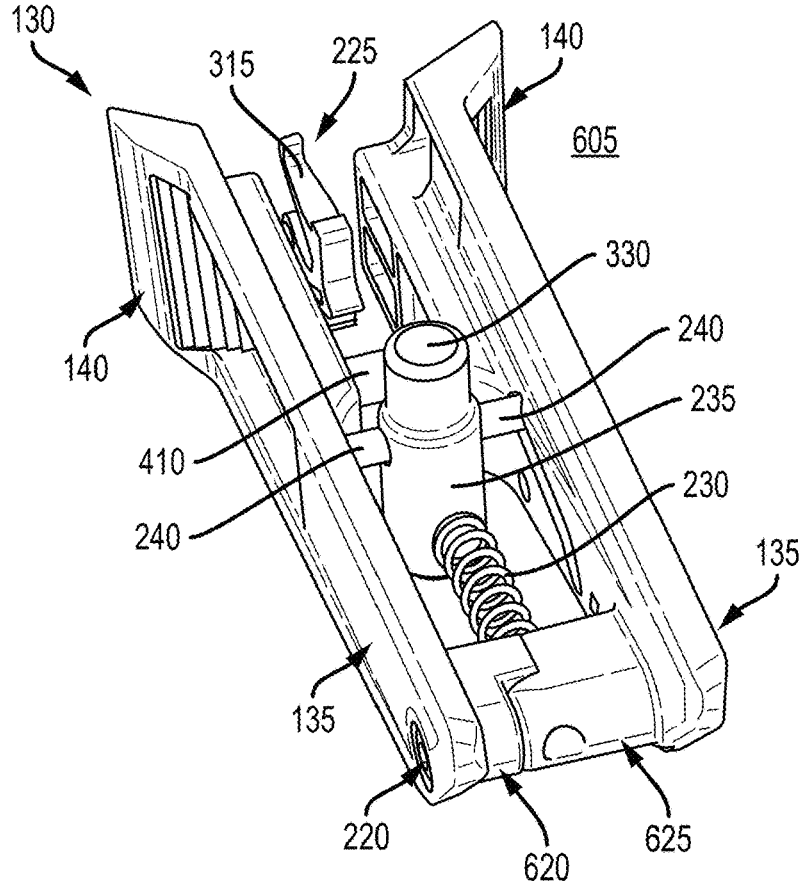
FIG. 6A depicts a view of an example of a stock assembly.

The stock assembly 100 may include two slider panels 135, e.g., a first slider panel 135 and a second slider panel 135. The first slider panel 135 and the second slider panel 135 may be located on opposite sides of the outer stock body 120. The first slider panel 135 may be coupled with the second slider panel 135 by a fastener extending through the internal cavity of the stock assembly 100, as depicted in FIG. 6A among others. The first slider panel 135 and the second slider panel 135 may travel along the horizontal track 740 defined by the body of the stock assembly 100, e.g., as depicted in FIGS. 7A-7F among others. For example, with the first slider panel 135 and the second slider panel 135 coupled, movement of one of the slider panels 135 causes movement of the other slider panel 135. With slider panels 135 on each side of the outer stock body 120, the stock assembly 100 may enable a user to adjust the stock assembly 100, e.g., with respect to a firearm, using a right hand or a left hand. In this example, the stock assembly 100 may be referred to as an ambidextrous stock assembly 100.

The stock assembly 100, e.g., the slider panel 135, may include at least one interface 140. For example, the exterior surface of the panel 135 may include the interface 140. With the stock assembly 100 including two opposing slider panels 135, each of the two slider panels 135 may include an interface 140. The user may engage the interface 140. For example, the user may engage the interface 140 to move the slider panel 135 and perform a LOP adjustment. For example, movement of the slider panel 135 is caused by user engagement with the interface 140. The interface 140 may be an extension or protrusion. For example, the interface 140 may extend away from an outside surface of the stock assembly 100, e.g., may extend outward from an exterior surface of the panel 135. In this example, the user may grasp the interface 140 with user objects, such as fingers. In other examples, the interface 140 may be a divot or intrusion. In this example, the user may insert a user object, such as a finger, into the interface 140.

The interface 140 may be arranged horizontally, e.g., between the proximal end and the distal end of the stock assembly 100. For example, the interface 140 may have an elongated shape with the longitudinal axis substantially orthogonal or oblique to the longitudinal axis of the outer stock body 120. In this example, user engagement may be promoted since a user can more easily contact the interface 140 while in movement. For example, the movement of the user may be in a direction substantially parallel to the longitudinal axis of the outer stock body 120 and towards the proximal end of the stock assembly 100. With the length of the interface 140 positioned obliquely to this movement, e.g., as opposed to parallel, the interface 140 has a larger engagement surface that can be more easily contacted by the user.

The interface 140 may include a textured surface. The textured surface of the interface 140 may promote user engagement or otherwise assist with user object placement. For example, the textured surface of the interface 140 may assist a user in positioning a user object, such as a finger, on or in contact with the interface 140. The textured surface of the interface 140 may be located on a distally facing surface of the interface 140. For example, a movement of the user may be in a direction substantially parallel to the longitudinal axis of the outer stock body 120 and towards the proximal end of the stock assembly 100. With the length of the interface 140 positioned obliquely to this movement, e.g., as opposed to parallel, and the interface 140 including the textured surface, the interface 140 has a larger engagement surface that can be more easily contacted as well as identified by the user. This Thus, with the interface 140 including an extension and/or a textured surface, the user may be enabled to make rapid as well as precise LOP adjustments, and additionally may easily remove or install the stock assembly 100. Additionally, the interface 140 may be familiar to the user, which may promote more efficient use of the interface 140. For example, with the interface 140 including an extension and/or a textured surface, the interface 140 may be similar to a trigger-pull type interface of a firearm.

FIG. 2 depicts a partially exploded view of the stock assembly 100. For example, the opposite side of the stock assembly 100 depicted in FIG. 1 is depicted in FIG. 2 and the slider panel 135 is not shown.

The stock assembly 100 may include or define at least one track, such as a first track 205 and a second track 210. The tracks 205, 210 may each have a longitudinal shape and may be referred to as longitudinal tracks 205, 210. The various elements described herein may travel along the tracks 205, 210. For example, the path of the various elements may be constrained by the tracks 205, 210 such that the elements travel along paths defined by the tracks 205, 210. In the example with two slider panels 135, the stock assembly 100 may include the tracks 205, 210 on either side of the stock assembly 100, e.g., beneath or under the slider panels 135. For example, the tracks 205, 210 may be located between the slider panels 135. For example, the tracks 205, 210 may be defined by a portion of the stock assembly 100 that is between the slider panel 135 and the interior cavity defined by the outer stock body 120.

The stock assembly 100 may include at least one extension or fastener, such as a first extension 215 and a second extension 220. The extensions 215, 220 may extend through the internal cavity of the stock assembly 100. The first slider panel 135 may be coupled with the second slider panel 135 by the first extension 215 and/or the second extension 220. For example, the extensions 215, 220 may be a screw-type fastener or the like, such as male and female aspects of a threaded screw-type interface, as shown in FIGS. 2, 3A-C, and 6B for example. In other examples, the extensions 215, 220 may be unitary structures or integral to the stock assembly 100. For example, with the extensions 215, 220 as unitary structures, the extensions 215, 220 may bind the first slider panel 135 with the second slider panel 135.

The stock assembly 100 may include a lever 225. The lever 225 may transition between a locked position 415 and an unlocked position 420, as depicted in FIGS. 4D-E among others. The lever 225 may inhibit the movement of the slider panel 135, e.g., with the lever 225 in the locked position 415. For example, the lever 225 may inhibit the slider panel 135 from movement toward the proximal end of the stock assembly 100.

The stock assembly 100 may include at least one biasing mechanism 230, such as a spring. The biasing mechanism 230 may be disposed in the internal cavity defined by the outer stock body 120. The biasing mechanism 230 may bias the slider panel 135. For example, the biasing mechanism 230 may bias or move the slider panel 135 toward the distal end of the stock assembly 100. For example, a user may engage the interface 140 and pull the interface 140 toward the proximal end of the stock assembly 100 from a first position to a second position, overcoming the biasing force of the biasing mechanism 230. Once the user disengages the interface 140, the biasing force of biasing mechanism 230 may return the slider panel 135 from the second position to the first position and thus move the slider panel 135 toward the distal end of the stock assembly 100. Thus, the movement of the first panel 135 and the second panel 135 may be caused by the biasing mechanism 230, e.g., and the movement may be toward the distal end of the stock assembly 100.

The stock assembly 100 may include at least one lock pin 235 and at least one release pin 240. The pins 235, 240 may each be disposed in the interior cavity defined by the stock assembly 100. The lock pin 235 and the release pin 240 may couple together to form a pin assembly, which may permit as well as inhibit movement of the stock assembly 100 with respect to the receiver extension 710. For example, the various elements of the stock assembly 100, such as the biasing mechanism 230, may interact with the pin assembly to transition the pin assembly to various positions, and depending on the position of the pin assembly, movement the stock assembly 100 may be permitted or inhibited.

Figure 3A:
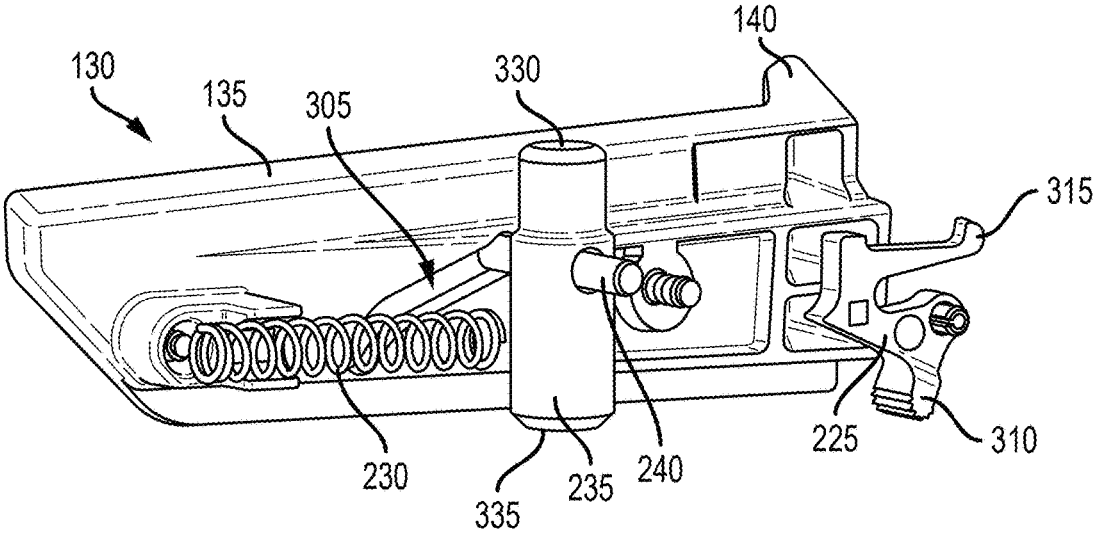
FIG. 3A depicts a partially exploded view of an example of a stock assembly.
Figure 3B:
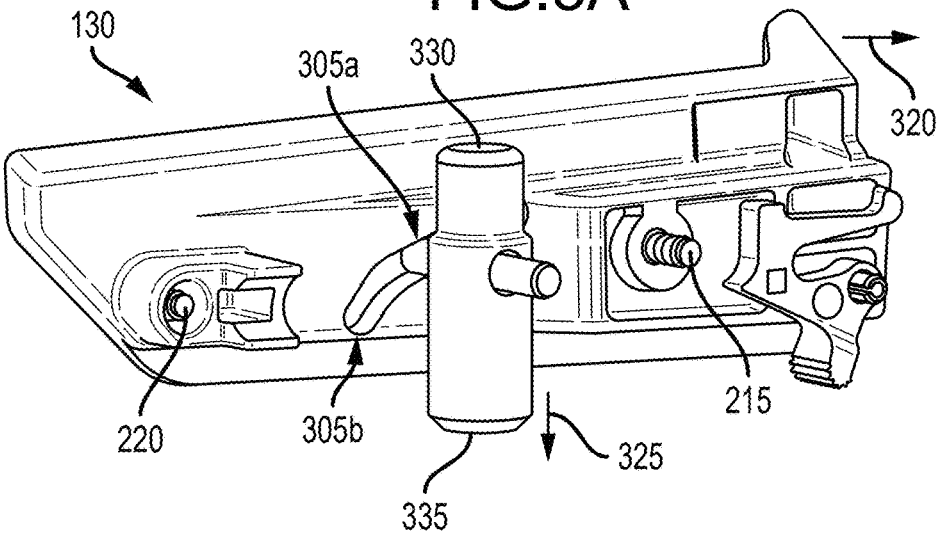
FIG. 3B depicts a partially exploded view of an example of a stock assembly.
Figure 3C:
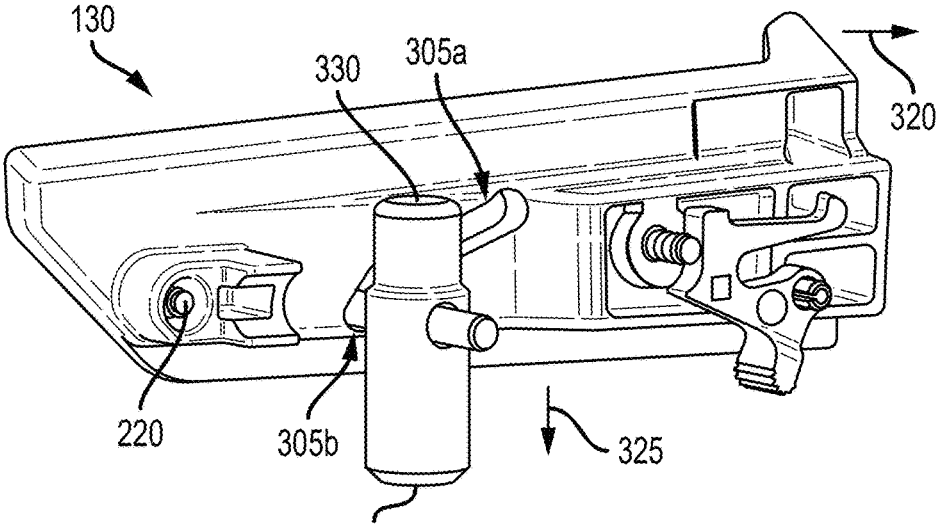
FIG. 3C depicts a partially exploded view of an example of a stock assembly.

FIGS. 3A-C depict partially exploded views the stock assembly 100. The lock pin 235 may be vertically arranged within the stock assembly 100, e.g., arranged between the two slider panels 135 or otherwise disposed in the internal cavity defined by the outer stock body 120. The release pin 240 may be horizontally arranged within the stock assembly 100, e.g., arranged between the two slider panels 135 or otherwise disposed in the internal cavity defined by the outer stock body 120.

The release pin 240 may be arranged through, affixed within, may extend through, or may couple with lock pin 235. For example, the lock pin 235 may define an aperture and the release pin 240 may extend through the aperture of the lock pin 235. For example, the release pin 240 may permanently attached to the lock pin 235 or moveably or releasably coupled with the lock pin 235. With the release pin 240 coupled with lock pin 235, a longitudinal axis of the lock pin 235 may be substantially orthogonal, substantially perpendicular, or oblique to a longitudinal axis of the release pin 240.

The stock assembly 100 may include or define at least one channel 305. For example, the interior surface of the panel 135 may define the channel 305. In the example with the stock assembly 100 including two panels 135, each of the two panels 135 may define a channel 305. The channel 305 may be angled or may include angled portions, as depicted in FIGS. 3A-C among others, and thus may be referred to as an angled channel 305. As used herein, the term "angled," can mean at an incline, arced, bowed, rounded, diagonal or slotted. In other examples, the channel 305 may be substantially vertical, as depicted in FIG. 2 among others. In this example, the stock assembly 100 may include an additional element that may convert translational sliding motion from one axis, e.g., in response to a force of the biasing mechanism 230, into another generally orthogonal axis, e.g., along the lock pin 235, or the biasing mechanism 230 may be positioned such that the lock pin 235 and the release pin 240 may translate vertically in response to a force of the biasing mechanism 230. For example, a longitudinal axis of the biasing mechanism 230 may be positioned substantially parallel or at a 45 degree angle to a longitudinal axis of the lock pin 235.

The release pin 240 may extend into the channel 305. For example, the release pin 240 may include an end portion that may extend into the channel 305. For example, the channel 305 may be positioned and shaped to accept the end of the release pin 240. In the example with the stock assembly 100 including two panels 135, the release pin 240 may include a first end portion and a second end portion. In this example, the release pin 240 may extend through the lock pin 235 and the first end portion of the release pin 240 may extend into a first channel 305 defined by the first slider panel 135 and a second end portion of the release pin 240 may extend into the second channel 305 defined by the second slider panel 135.

The longitudinal axis of the lock pin 235 may be substantially orthogonal, substantially perpendicular, or oblique to a longitudinal axis of the biasing mechanism 230. The longitudinal axis of the release pin 240 may be substantially orthogonal, substantially perpendicular, or oblique to the longitudinal axis of the biasing mechanism 230. The lock pin 235 may contact the biasing mechanism 230 and/or the biasing mechanism 230 may contact the lock pin 235.

The release pin 240 may travel along a path defined by the channel 305, e.g., in response to movement of the slider panel 135 or in response to movement of the biasing mechanism 230. For example, the channel 305 may constrain movement of the release pin 240 such that the release pin 240 may travel along a fixed path defined by the channel 305.

The release pin 240 may cause the lock pin 235 to transition from a first position to a second position in response to movement of the slider panel 135 or in response to movement of the biasing mechanism 230. The release pin 240 may translate longitudinal motion of the slider panel 135 to perpendicular or semi-perpendicular motion of the lock pin 235. For example, the release pin 240 may indirectly moveably couple the slider panel 135 and the lock pin 235 together, such that movement of the slider panel 135 causes movement of the lock pin 235.

In another example, the release pin 240 may translate longitudinal motion of the biasing mechanism 230 to perpendicular or semi-perpendicular motion of the lock pin 235. For example, the biasing force of the biasing mechanism 230 may cause longitudinal motion of the biasing mechanism 230 and the biasing force may be applied to the lock pin 235 and cause the release pin 240 to travel along the path defined by the channel 305, which in turn translates the lock pin 235 in a vertical manner. In this way, the channel 305 may constrain movement of the lock pin 235 such that the lock pin 235 may travel along a fixed path defined by the channel 305. In this example, the biasing mechanism 230 may bias the slider panels 135 toward the distal end of the stock assembly 100, e.g., since the release pin 240 may indirectly and moveably couple the lock pin 235 with the slider panels 135.

Longitudinal motion refers to the motion of the slider panel 135 in a direction that is parallel to the direction of energy transport, such as a user engaging the interface 140 and pulling the slider panel 135 toward the proximal end of the stock assembly 100.

The lock pin 235 may include a top portion or surface 330 and a bottom portion or surface 335. The top surface 330 of the lock pin 235 may engage with a pocket 720 of the receiver extension 710, as depicted in FIG. 7B among others, for example with the lock pin 235 in a locked position, as depicted in FIG. 3A among others. The bottom surface 335 of the lock pin 235 may extend outside of the outer surface of the stock assembly 100, as depicted in FIG. 7C among others, for example with the lock pin 235 in an unlocked position, as depicted in FIG. 3C among others.

With the slider panel 135 pulled proximally by a user, as depicted by horizontal arrow 320, the release pin 240, and thereby the lock pin 235, are forced downward, as depicted FIGS. 3B-C among others. As the lock pin 235 transitions downward, as depicted by vertical arrow 325, the top portion 330 of the lock pin 235 disengages from the pocket 720 of the receiver extension 710. With the slider panel 135 pulled proximally to a point that causes the lock pin 235 to clear the pocket 720, the stock assembly 100 may be moved distally or proximally along the receiver extension 710. Additionally, with the slider panel 135 pulled proximally, the biasing mechanism 230 (not shown in FIGS. 3B-C for clarity) is compressed.

At a LOP acceptable to the user, the user may release the slider panel 135 and the biasing mechanism 230 may decompress or expand. Upon decompression of the biasing mechanism 230, the biasing mechanism 230 may contact the lock pin 235 and press the lock pin 235 up, e.g., with the release pin 240 constrained to the path defined by the channel 305, and into another pocket defined by the receiver extension 710. Since release of the interface 140 causes direct movement of the biasing mechanism 230, similar to a trigger assembly of a firearm, the slider assembly 130 may be referred to as a trigger release adjustment mechanism or assembly.

In some examples, the top surface 330 of the lock pin 235 may contact an outside surface of the receiver extension 710, in which case the user may slide the stock assembly 100 proximally or distally along the receiver extension 710 until the lock pin 235 engages the nearest pocket. With the top portion 330 of the lock pin 235 residing in a pocket of the receiver extension 710, the slider assembly 130, e.g., the slider panel 135, may be returned to a resting position or distal position. In other words, the biasing mechanism 230 may return the slider panel 135 to a distal position when a user is not actively pulling the slider panel 135 rearward or proximally.

For example, FIG. 3A shows the slider assembly 130 in an at rest or distal position, FIG. 3B shows the slider assembly 130 as the slider panel 135 is slightly pulled proximally (the biasing mechanism 230, not depicted for clarity, is slightly compressed in this position), and FIG. 3C shows the slider assembly 130 with the slider panel 135 at a proximal-most position, and with the lock pin 235 fully retracted from the pocket 720 of the receiver extension 710 (the biasing mechanism 230, not depicted for clarity, is compressed in this position). As depicted in FIG. 3C, the distal end of the channel 305 acts as an overtravel stop for the slider panel 135. The channel 305 may include at least one section, such as an upper portion or section 305*a* and a lower portion or section 305*b*.

In an example with two slider panels 135, the lock pin 235 may be in the locked position, in which the first end portion of the release pin 240 may extend into an upper portion 305*a* of the first channel 305 and the second end portion of the release pin 240 may extend into an upper portion 305*a* of the second channel 305. In this position, the top portion 330 of the lock pin 235 may extend into the pocket 720 of the receiver extension 710 and the stock assembly 100 may be inhibited from sliding along a length of the receiver extension 710.

Additionally, the lock pin 235 may transition into the unlocked position in response to movement of the first panel 135 and the second panel 135. The movement may be caused by user engagement with at least one of the interface 140 of the first panel 135 or the interface 140 of the second panel 135 and the movement of the first panel 135 and the second panel 135 is toward the proximal end of the stock assembly 100. With the lock pin 235 in the unlocked position, the first end portion of the release pin 240 may extend into the lower portion 305*b* of the first channel 305 and the second end portion of the release pin 240 may extend into the lower portion 305*b* of the second channel 305. In this position, the top portion 330 of the lock pin 235 may not extend into the pocket 720 of the receiver extension 710 and the stock assembly 100 may slide or move along a length of the receiver extension 710.

In the example with the channel 305 angled, the upper portion 305*a* may be a shallow section 305*a* and the lower portion 305*b* may be a steep section 305*b*. The upper section 305*a* may be first engaged with the slider panel 135 at rest and additionally with the slider panel 135 initially pulled proximally. With the release pin 240 traveling along this upper section 305*a*, the lock pin 235 may retract at a first rate. The upper section 305*a* may be long enough to allow the lock pin 235 to be fully disengaged from the pocket 720 of the receiver extension 710. The receiver extension 710 may include a channel or extension that runs a length of the pockets 720 and has a shallower depth than the pockets 720.

This channel may permit the lock pin 235 to move between pockets 720, but inhibit the stock assembly 100 from being inadvertently removed from the receiver extension 710.

With the slider panel 135 pulled further in the proximal direction, the lock pin 235 may engage the lower section 305*b*. The lower section 305*b* may be shorter than the upper section 305*a*, and given its steeper angle, the lock pin 235 is pulled downward at a greater rate per proximal movement of the slider panel 135 than the rate of the lock pin 235 in the upper section 305*a*.

Additionally, a greater force may be used on the slider panel 135 for the release pin 240 to traverse the lower section 305*b* than the force used on the slider panel 135 for the release pin 240 to traverse the upper section 305*a*. This greater force may provide tactile feedback to a user indicating that the user has reached the maximum pull distance to allow the lock pin 235 to disengage from the pocket 720. Further, the greater resistance to the movement of the lock pin 235 in the lower section 305*b* provides tactile feedback that a user is moving toward removal of the entire stock assembly 100, and this in turn helps to prevent accidental removal of the stock assembly 100.

It should be noted that the angles and lengths of the upper and lower sections 305*a* and 305*b* are illustrative only and not intended to limit alternatives to the structure shown. However, the shallow angle of the upper section 305*a* can be selected to achieve a desired resistance to user displacement of the slider panel 135 and hence the lock pin 235. Additionally, translating lateral movement of the slider panel 135 to vertical movement of the lock pin 235 via the upper section 305*a* achieves a leverage, and thus ease of operation, not seen in prior art mechanisms that directly apply a roughly vertical force to the lock pin via a pivoting lever. By removing the need for a pivoting action and orienting the biasing mechanism 230 away from the vertical axis of the lock pin 235, this slider assembly 130 may achieve a slimmer vertical profile in the area of the lock pin 235.

The stock assembly 100, e.g., the lever 225, may include at least one arm 315. The arm 315 may be cantilevered and may interface with an interior surface of the stock assembly 100, as depicted in FIGS. 4B-C among others. The lever 225 may include a biasing mechanism, e.g., an integral spring, (not shown). The biasing mechanism of the lever 225 may inhibit the lever 225 from transitioning between the locked position 415 and the unlocked position 420 without user engagement.

The stock assembly 100, e.g., the lever 225, may include at least one user interface 310. The user interface 310 may be accessible on a bottom surface of the stock assembly 100. Additionally, the lever 225 may be at least partially recessed within the stock assembly 100, which may inhibit a user snagging or otherwise undesirably contacting the user interface 310, while still permitting easy access for the user to engage the user interface 310 when desired.

A user may engage the user interface 310 to transition the lever 225 between the locked position 415 and the unlocked position 420, as depicted in FIGS. 4D-E among others. For example, the lever 225 may transition between a first state and a second state, e.g., between the locked position 415 and the unlocked position 420. With the lever 225 in the locked position 415, the lever 225 is arranged to inhibit retraction of the slider panel 135 toward a proximal end of the stock assembly 100. Additionally, with the lever 225 in the unlocked position 420, the lever 225 is arranged to permit retraction of the slider panel toward 135 the proximal end of the stock assembly 100. In some examples, with the lever 225 in the locked position 415, the lever 225 is arranged to permit retraction of the slider panel toward 135 the proximal end of the stock assembly 100 but inhibit removal of the stock assembly 100 from the receiver extension 710. Thus, with the lever 225 positioned in the locked position 415, the stock assembly 100 is inhibited from being removed from the receiver extension 710, enabling the user to make LOP adjustments without permitting the stock assembly 100 from sliding off the receiver extension 710 entirely.

This easily accessible user interface 310 enables the user to quickly and easily install and remove the stock assembly 100. For example, the lever 225 may inhibit accidental removal of the stock assembly 100 from the receiver extension 710. In particular, the lever 225 may restrict proximal movement of the extension 215, which in turn may restrict the release pin 240 from entering the second section 305*b*. Accordingly, the lock pin 235 may remain in contact with the receiver extension 710 and may be permitted to move between the pockets 720. However, with the lever 225 in the locked position 415, the lever 225 may prevent the stock assembly 100 from being completely removed from the receiver extension 710. In some examples, the lever 225 may act as an impedance to the slider assembly 130 being pulled distally to its full extent. In some examples, the lever 225 indexes to inform the user of its positional status informing whether the stock assembly 100 is "locked" onto the receiver extension 710. In some examples, the lever 225 may be arranged to prevent full retraction of the slider panel 135 in a first state, e.g., in the locked position 415, and to allow full retraction of the slider panel 135 in a second state, e.g., the unlocked position 420.

Figure 4A:
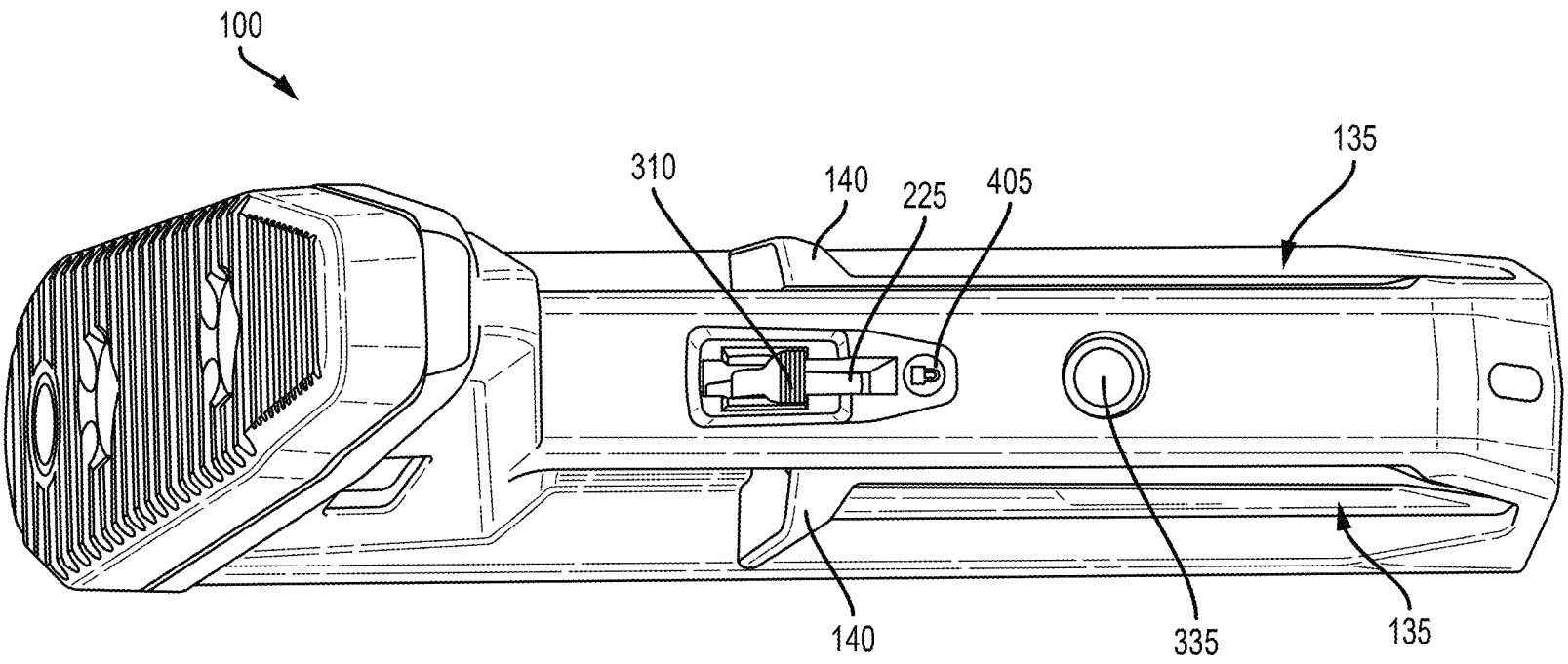
FIG. 4A depicts a view of an example of a stock assembly.
Figure 4B:
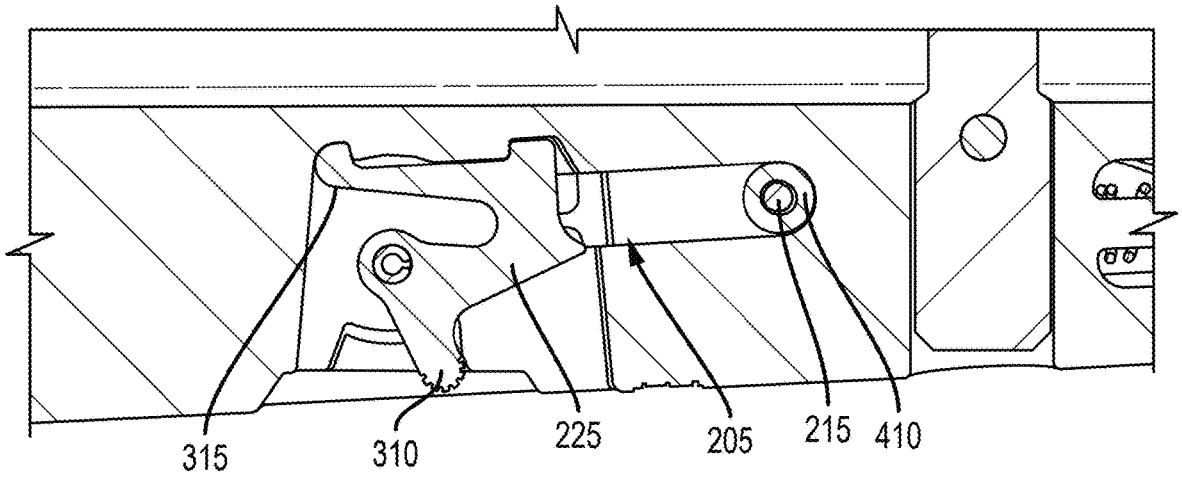
FIG. 4B depicts a cross-section view of an example of a stock assembly.
Figure 4C:
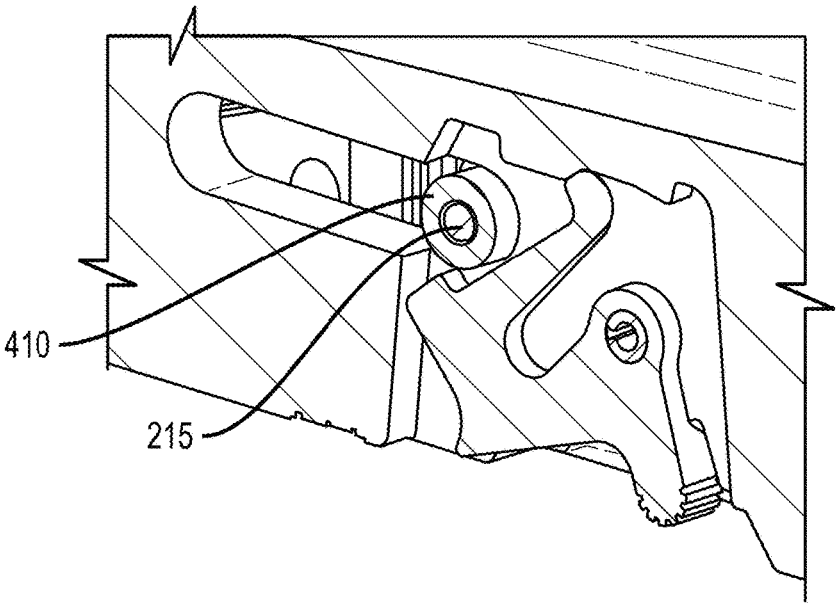
FIG. 4C depicts a cross-section view of an example of a stock assembly.
Figure 4E:
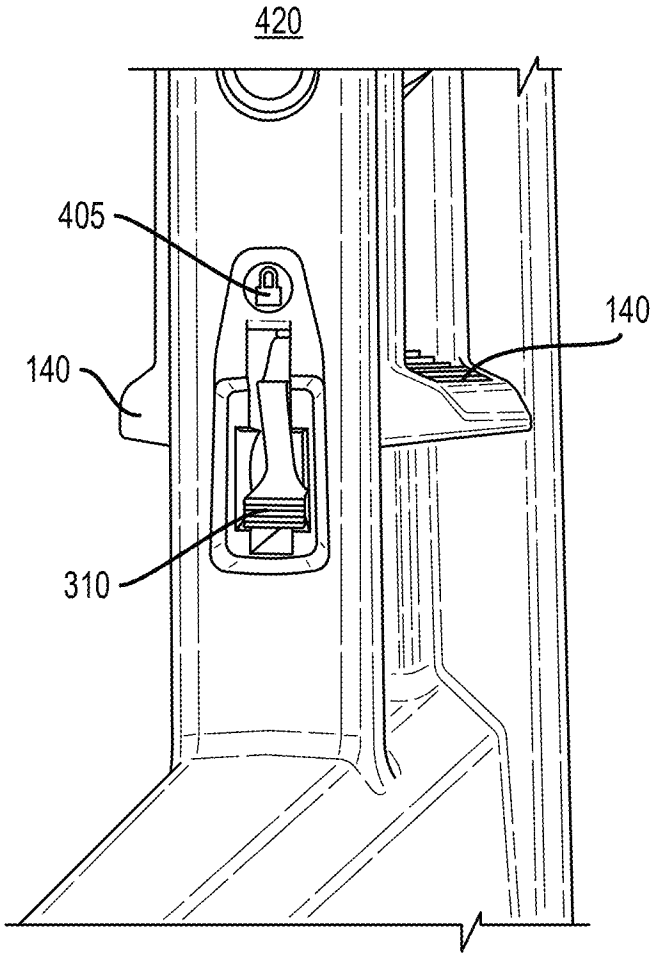
FIG. 4E depicts a view of an example of a stock assembly.
Figure 4D:
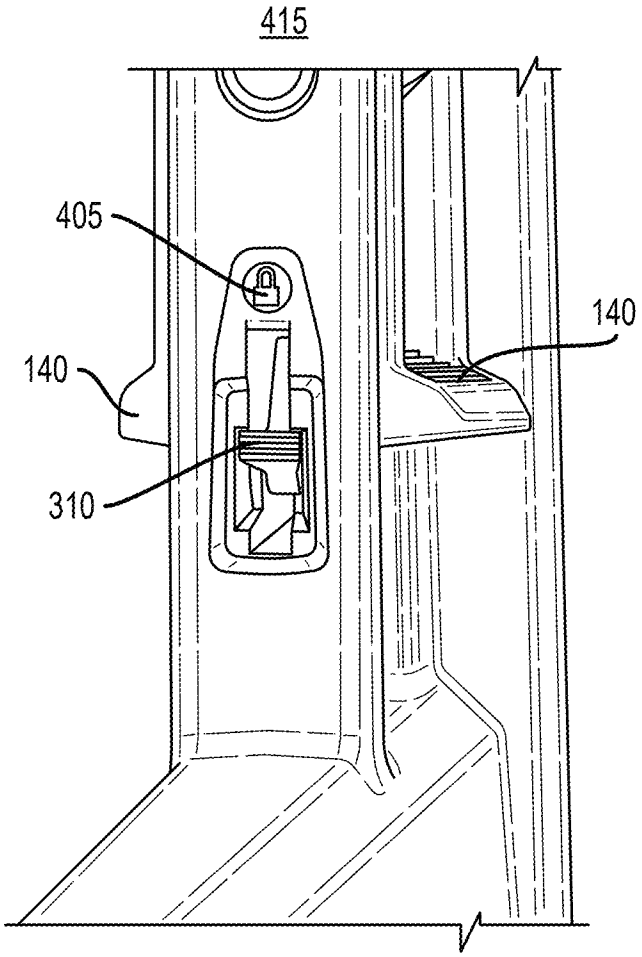
FIG. 4D depicts a view of an example of a stock assembly.

FIGS. 4A, 4D, and 4E depict bottom views of the stock assembly 100. The stock assembly 100 depicted in FIG. 4A includes the first slider panel 135 and the second slider panel 135, and each of the slider panels 135 includes an interface 140. Additionally, the bottom surface 335 of the lock pin 235 is depicted, with the lock pin 235 in the locked position. The lever 225 and the user interface 310 of the lever 225 is also depicted.

The stock assembly 100 may include at least one icon 405. The icon 405 may signal to a user whether the lever 225 is in the locked position 415 or the unlocked position 420. Additionally or alternatively, the icon 405 may signal to a user that the lever 225 is present and able to lock the stock assembly 100 in place or lock the stock assembly 100 onto the receiver extension 710 such that removal of the stock assembly 100 from the receiver extension 710 is inhibited.

Figure 6B:
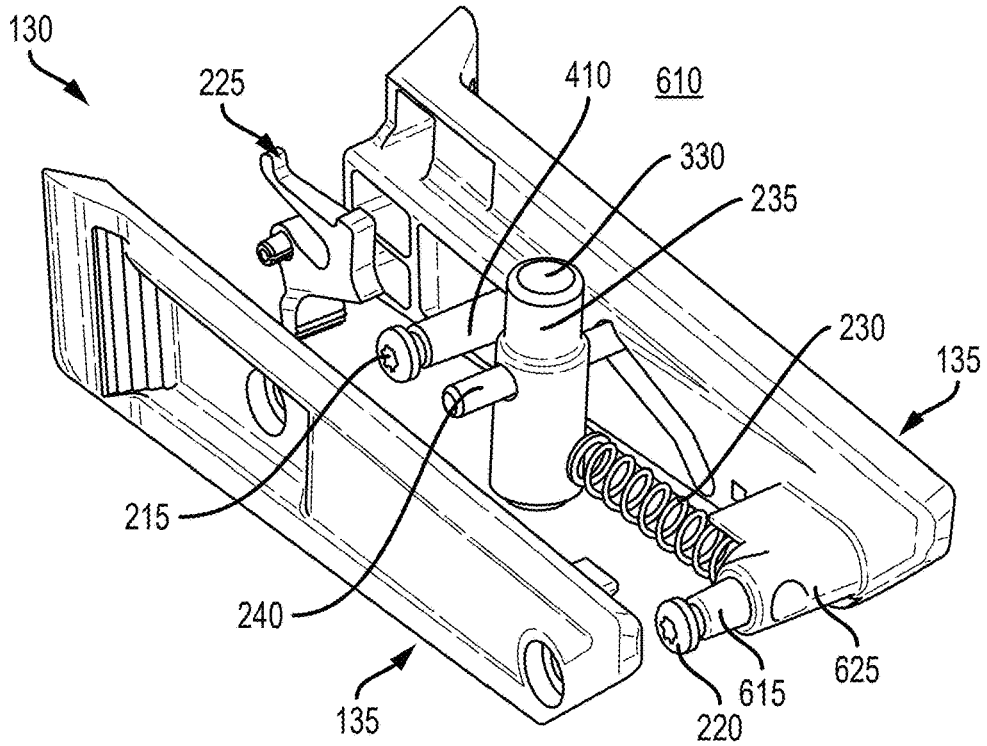
FIG. 6B depicts a partially exploded view of an example of a stock assembly.

FIGS. 4B-C depict cross-section views of the stock assembly 100. The stock assembly 100 may include an extension 410. FIG. 4B depicts the lever 225 in the locked position 415 and the slider panel 135 in the resting position. For example, the extension 215 is a screw type fastener received within the extension 410, e.g., each of the extensions 215, 410 may include threaded surfaces that may engage with each other. The extensions 215, 410 are also depicted in FIGS. 6A-B among others. FIG. 4C depicts the lever 225 in the unlocked position 420 and the slider panel 135 in an actuated position, e.g., pulled toward a proximal end of the stock assembly 100. For example, the extensions 215, 410 have transitioned across the track 205 and are abutting the lever 225.

The lever 225 may extend partially into the proximal track 205, with a pivot axis behind the proximal track 205. In this example, the lever 225 may prevent full travel, or retraction, of the slider panel 135. It should be noted that at the point where the slider extension 215 meets the lever 225 when sliding proximally, the angle of the track 305 interfacing with the release pin 240 changes from the upper section 305*a* to the lower section 305*b*. With the lever 225 rotated, the slider extension 215 may continue to be pulled proximally through the track 205 until reaching a proximal end of the track 205. During this latter phase of traversal, the release pin 240 is traveling through the steeper lower section 305*b* of the channel 305. Thus, the proximal track 205 sets the limit of travel of the slider panels 135 in conjunction with the lever 225. Alternatively, or in combination with the proximal track 205 and the lever 225, a distal end of the lower channel 305*b* can limit travel of the slider panels 135. As shown, the two tracks 205, 210 may have different dimensions associated with their differing tasks.

Figure 5:
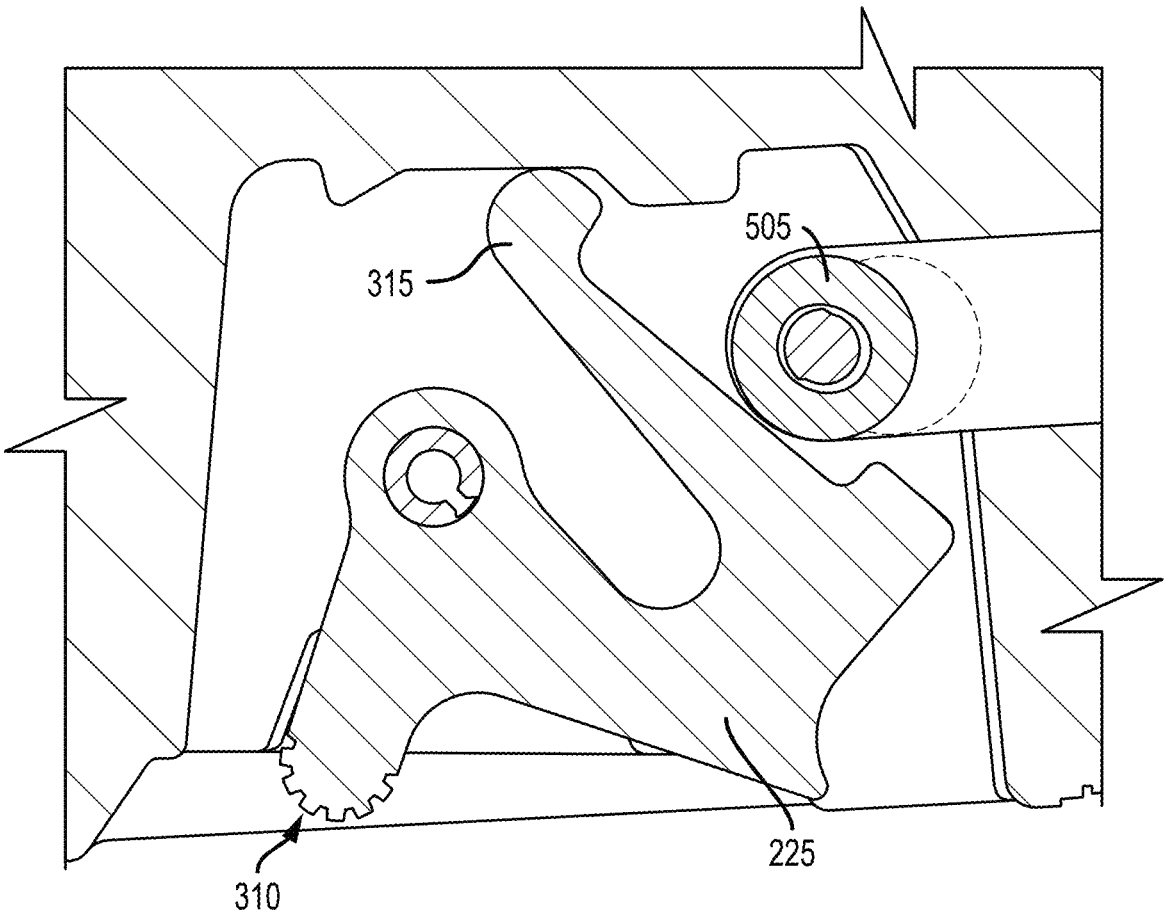
FIG. 5 depicts a cross-section view of an example of a stock assembly.

FIG. 5 depicts another example of the lever 225. The lever 225 may include a biasing mechanism, e.g., an integral spring, (not shown) and/or a detent. The detent may be a mechanical or magnetic means to resist or arrest the movement of a mechanical device, such as the lever 225. The integral spring and the detent may be formed from the arm 315. The lever 225 may be or may include a polymer material. The lever 225 may include an integral toggling detent system powered by a cantilevered bending arm 315. Mating features 505 in the body of the stock assembly 100 may interface with an end of the arm 315 of the lever 225 to provide the detent effect. The lever 225 may include an integral spring and detent formed from a cantilevered arm 315 configured to interface with the lower stock assembly 110.

FIGS. 6A and 6B depict an assembled view 605 and an exploded view 610 of the stock assembly 100, respectively. The stock assembly 100 may include an extension 615. For example, the extension 220 is a screw type fastener received within the extension 615, e.g., each of the extensions 220, 615 may include threaded surfaces that may engage with each other. The stock assembly 100 may include a first connection interface 620 and a second connection interface 625. The connection interfaces 620, 625 may house the extensions 220, 615 or the extensions 220, 615 may integrally extend from the connection interfaces 620, 625. Additionally, the biasing mechanism 230 may extend from the first connection interface 620 and/or the second connection interface 625.

As depicted in FIGS. 6A and 6B, the extensions 410, 215, 615, 220 may extend between and couple the slider panels 135. For example, the slider panels 135 may connect through the interior cavity of the stock assembly 100, each set of extensions 410, 215 and 615, 220 through the two longitudinal tracks 205, 210. As depicted in FIGS. 2 and 6B, the two slider extensions 215, 220 may extend perpendicular to the longitudinal axis of the stock body 120 and interface with the extensions 410, 615, respectively. The extensions 410, 615 may be female threaded extensions 410, 615, for example in the example that the extensions 215, 220 are screws. The extensions 410, 615 may extend from one the interior surface of either panel 135. Additionally, the release pin 240 may extend between and contact the interior surface of slider panels 135, e.g., the channels 305.

The biasing mechanism 230 may be disposed between the two slider panels 135. For example, the biasing mechanism 230 may be arranged within a distal portion or region of the stock assembly 100. The first extension 220 or extension assembly 220,615 may compress the biasing mechanism 230, e.g., with the panel 135 pulled proximally. The second extension or extension assembly 215, 410 may be arranged in a proximal portion or region of the stock assembly 100. Movement of one or of both extensions 220 and 215 may be constrained in a vertical direction by the tracks 205, 210, which may help guide movement of the panels 135 horizontally.

FIGS. 7A-F depict various stages of installation of the stock assembly 100. The stock assembly 100 may be coupled with a firearm 715. The firearm 715 may include the receiver extension 710. The receiver extension 710 may be referred to as a buffer tube, a buffer tube assembly, a receiver extension tube, a carbine receiver extension tube, or the like. The stock assembly 100 may be installed on a receiver extension 710 manufactured by a variety of manufacturers. The receiver extension 710 may define at least one hole or pocket 720.

Figure 7A:
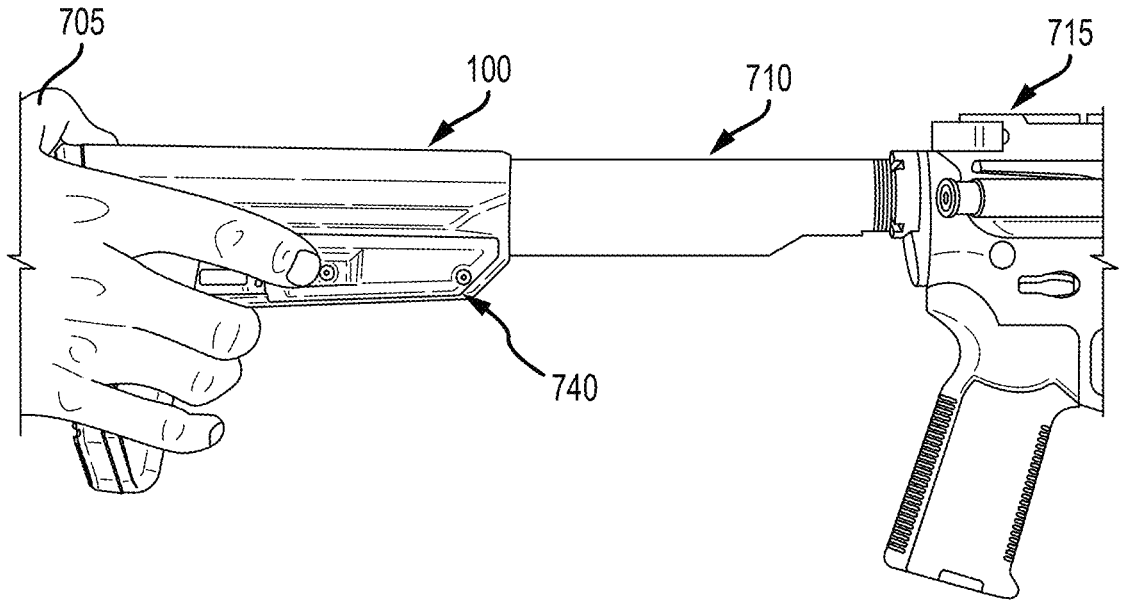
FIG. 7A depicts a view of an example of a stock assembly installation.
Figure 7B:
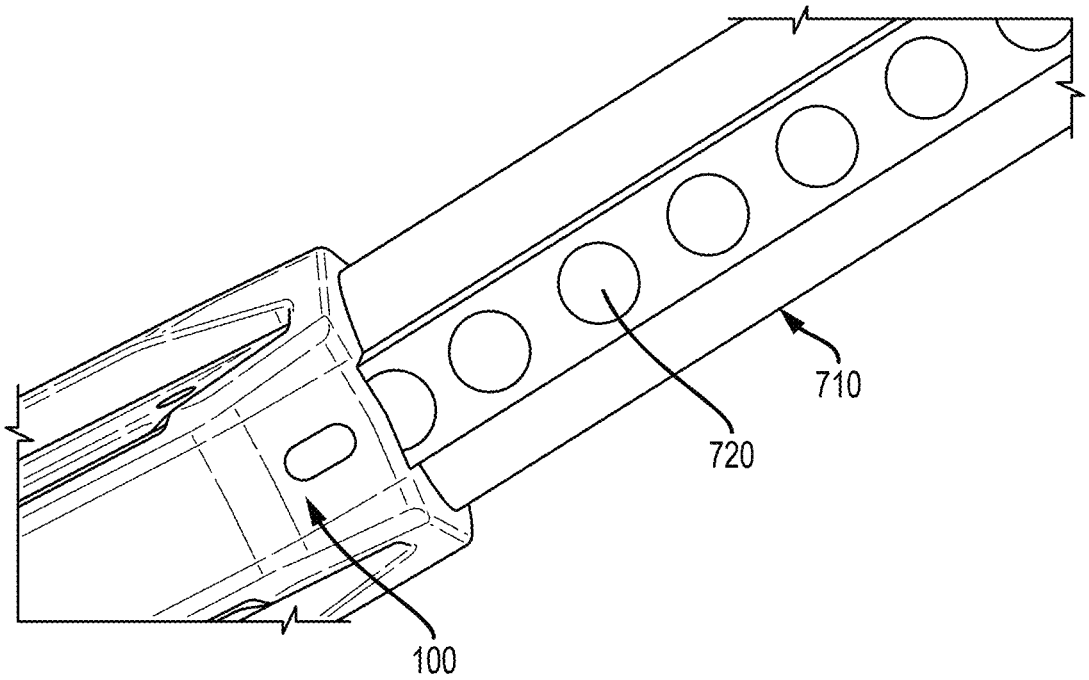
FIG. 7B depicts a view of an example of a stock assembly installation.
Figure 7C:
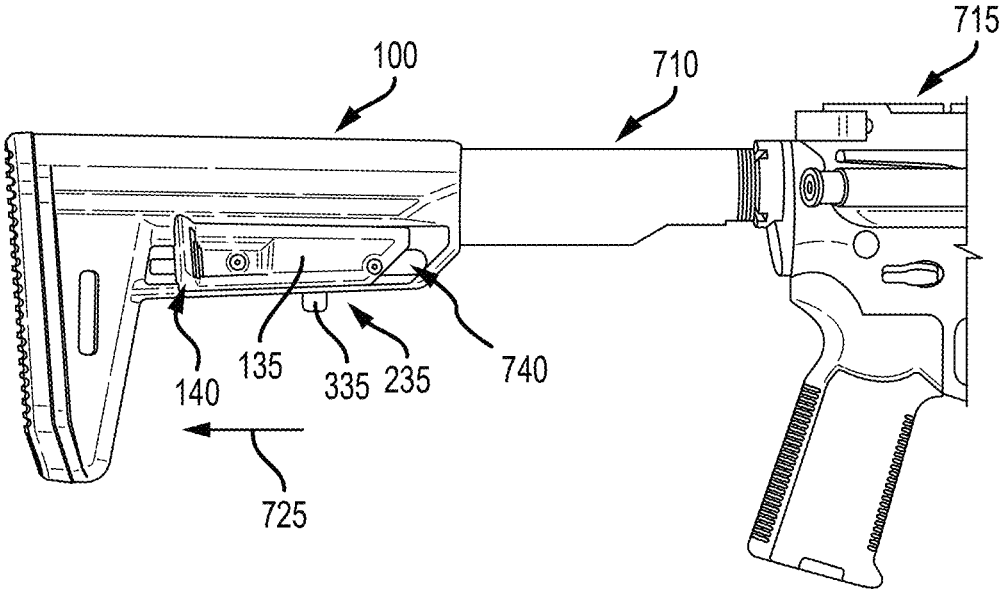
FIG. 7C depicts a view of an example of a stock assembly installation.

As depicted in FIGS. 7A-B, a user 705 may align the stock assembly 100 with the firearm 715, e.g., the receiver extension 710. The user 705 may slide the stock assembly 100 and the receiver extension 710 together. For example, the user 705 may slide the stock assembly 100 onto the receiver extension 710 about 2 and ⅛ inches. Prior to positioning the stock assembly 100 on the receiver extension 710, the user 705 may actuate the lever 225 to the unlocked position 420.

As depicted in FIG. 7C among others, the user 505 (not shown for clarity) may actuate the panel 135 rearward, e.g., in an operational orientation of the stock assembly 100, as depicted by arrow 725. For example, the user 505 may engage the interface 140 and pull the panel 135 towards the proximal end of the stock assembly 100.

For example, the movement of the panel 135 may be caused by user engagement with the interface 140 and the movement of the panel 135 may be toward the proximal end of the stock assembly 100. The movement of the panel 135 may cause the lock pin 235 to transition between a first position, e.g., a locked position, and a second position, e.g., an unlocked position. With the lock pin 235 in the first position, the release pin 240 may extend into the upper portion 305*a* of the channel 305 and with the lock pin 235 in the second position, the release pin 240 may extend into the lower portion 305*b* of the channel 305. With the lock pin 235 in the first position, a portion, e.g., the top portion 330, of the lock pin 235 may extend into the pocket 720 defined by the receiver extension 710. With the lock pin 235 in the second position, the portion of the lock pin 235 may not extend into the pocket 720 of the receiver extension 710. For example, a portion of the lock pin 235, such as the bottom portion 335, may extend from a bottom surface of the stock assembly 100. With the lock pin 235 in the second position, the stock assembly 100 may be enabled to slide, move, or translate along a length of the receiver extension 710.

Figure 7D:
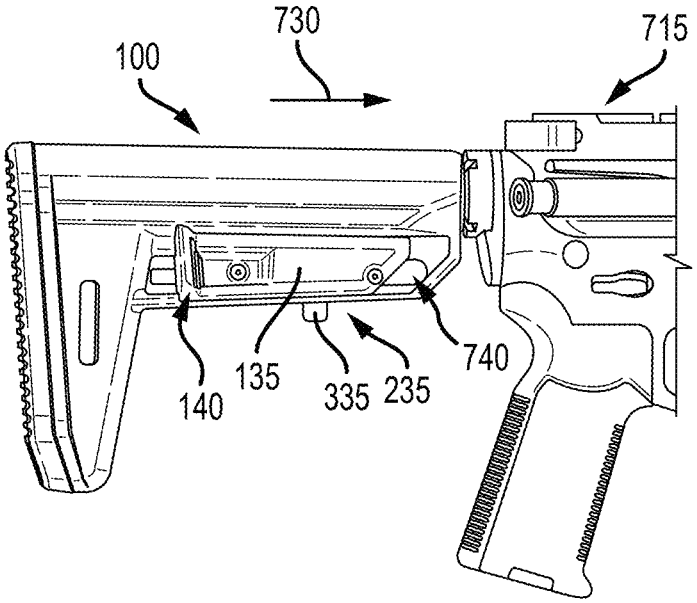
FIG. 7D depicts a view of an example of a stock assembly installation.

As depicted in FIG. 7D among others, the user 505 (not shown for clarity) may actuate the stock assembly 100 forward, e.g., in an operational orientation of the stock assembly 100, as depicted by arrow 730. For example, the user 505 may engage the interface 140 and hold the panel 135 rearward as well as push the stock assembly 100 forward, e.g., toward the proximal end of the firearm 715. The user 505 may actuate the stock assembly 100 to a forward-most position, e.g., the entire length of the receiver extension 710, as depicted in FIG. 7D among others. In the forward-most position the stock assembly 100 may abut or otherwise contact the firearm 715. In other examples, the user 505 may actuate the stock assembly 100 to an intermediate position, e.g., a position that is less than the entire length of the receiver extension 710. For example, the user 505 may actuate the stock assembly 100 to any position on the receiver extension 710 that the user 505 desires.

Figure 7E:
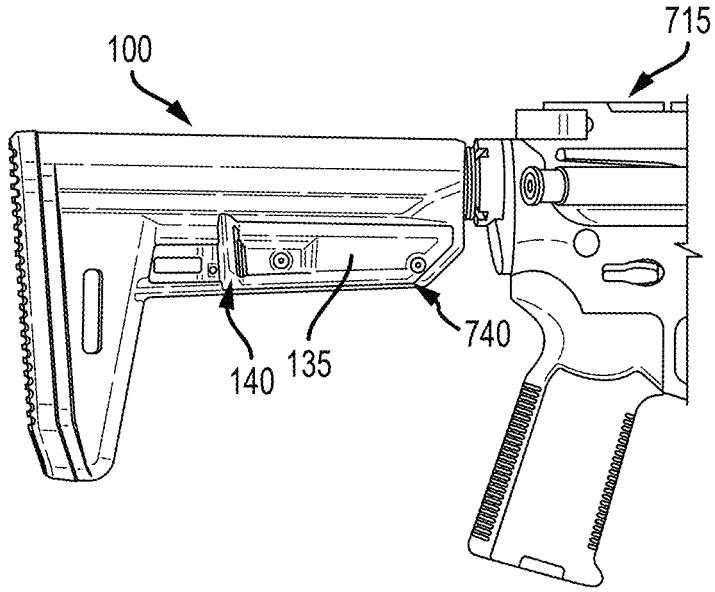
FIG. 7E depicts a view of an example of a stock assembly installation.

As depicted in FIG. 7E among others, the user 505 (not shown for clarity) may release the panel 135. For example, the user 505 may disengage the interface 140. Disengagement of the panel 135, e.g., the interface 140, by the user 505 may cause the panel 135 to slide or move forward, e.g., in an operational orientation of the stock assembly 100. For example, the user 505 may disengage the interface 140 and the panel 135 may move, slide, or translate towards the distal end of the stock assembly 100.

Figure 7F:
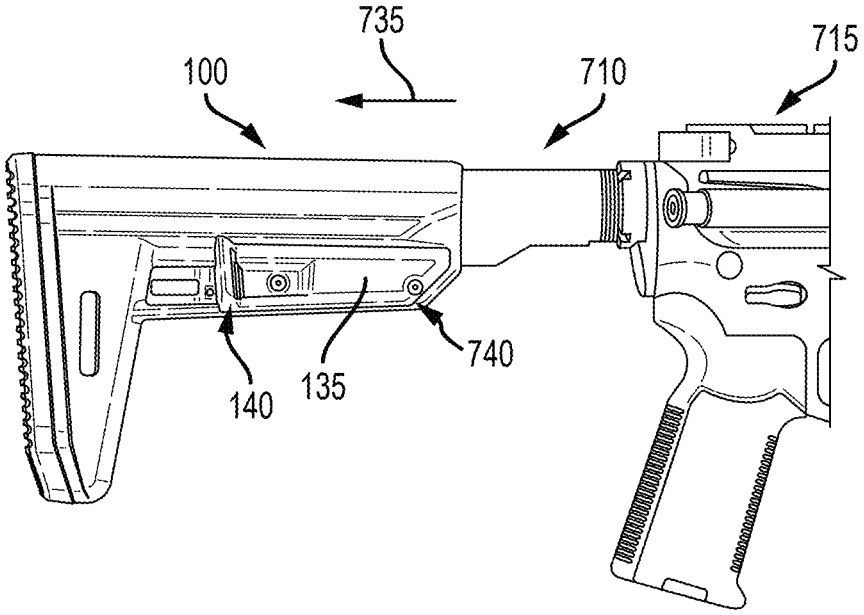
FIG. 7F depicts a view of an example of a stock assembly installation.

For example, the movement of the panel 135 may be caused by the biasing mechanism 230 and the movement of the panel 135 may be toward the distal end of the stock assembly 100. The movement of the panel 135 may cause the lock pin 235 to transition between a first position, e.g., an unlocked position, and a second position, e.g., a locked position. With the lock pin 235 in the first position, the release pin 240 may extend into the lower portion 305*b* of the channel 305. With the lock pin 235 in the first position, a portion of the lock pin 235, such as the top portion 330, may not extend into a pocket 720 defined by the receiver extension 710. With the lock pin 235 in the second position, the release pin 240 may extend into the upper portion 305*a* of the channel 305 and the portion of the lock pin 235, e.g., the top portion 330, may extend into the pocket 720 of the receiver extension 710. In some examples, the top portion 330 of the lock pin 235 may extend upward and contact or abut an exterior surface of the receiver extension 710 and not initially extend into the pocket 720. In these examples, the user 505 may actuate the stock assembly 100 either forward or rearward until the lock pin 235 engages a pocket 720. During this actuation, the release pin 240 may not extend into the upper-most portion of the upper portion 305*a* of the channel 305, and the panel 135 may not sit within the distal-most portion of the horizontal track 740 defined by the body of the stock assembly 100, as depicted in FIG. 7F among others. For example, the release pin 240 may extend into a middle portion of the upper portion 305*a* of the channel 305 and the panel 135 may sit in a middle portion of the track. With the lock pin 235 in the second position, the stock assembly 100 may be inhibited from sliding along a length of the receiver extension 710. For example, the lock pin 235 may be referred to as a fastener since the lock pin 235 may fasten or secure the stock assembly 100 in a position along the receiver extension 710.

As depicted in FIG. 7F among others, the user 505 (not shown for clarity) may actuate the stock assembly 100 rearward, e.g., in an operational orientation of the stock assembly 100, as depicted by arrow 735. For example, the user 505 may actuate the stock assembly 100 forward the full length of the receiver extension 710 and then may actuate the stock assembly 100 rearward to a desired position to give the desired LOP. In other examples, the user 505 may actuate the stock assembly 100 forward to the desired position to give the desired LOP without readjusting the stock assembly 100 rearward. In some examples, the stock assembly 100 may provide a LOP adjustment range greater than or equal to about 1 inch and less than or equal to about 8 inches. For example, the stock assembly 100 may provide a LOP adjustment range of about 3.3 inches. In this example, the receiver extension 710 may be an M4 Carbine receiver extension platform and the stock assembly 100 receiver extension 710 combination may be about 10.5 inches in a collapsed state and may be about 13.8 inches in an extended state.

Once the stock assembly 100 is in a position desired by the user 505, the user 705 may actuate the lever 225, e.g., from the unlocked position 420 to the locked position 415. With the lever 225 in the locked position 415, the lever 225 may inhibit the movement of the slider panel 135 and lock the top portion 330 of the lock pin 235 in the pocket 720 defined by the receiver extension 710. In other examples, the lever 225 may only lock the stock assembly 100 on the receiver extension 710 and not inhibit movement of the panel 135 and thus the lock pin 235. In this example, the user 505 may actuate the panel 135 and perform LOP adjustments with the lever 225 in the locked position 415 and inhibiting full removal of the stock assembly 100 from the firearm 715.

The user 505 may remove the stock assembly 100 from the firearm 715. For example, the user 505 may actuate the panel 135 reward to disengage the top portion 330 of the lock pin 235 from the pocket 720, and may actuate the stock assembly 100 rearward, e.g., away from the proximal end of the firearm 715, until the stock assembly 100 is unmounted from the receiver extension 710. In the examples with the stock assembly 100 including the lever 225, the user 505 may actuate the lever 225 from the locked position 415 to the unlocked position 420 prior to engaging the interface 140 and actuating the panel 135 reward.

For example, for installation and removal, the lever 225 may be activated via proximal force on the user interface 310, which may cause the lever 225 to rotate and make way for a fuller proximal movement of the threaded extension 410 (see FIG. 4C as compared to FIG. 4B). In turn this allows for additional linear travel of the panel 135, which may force the release pin 240 into the lower section 305*b* of the channel 305, which may allow the lock pin 235 to retract enough to completely clear the receiver extension 710, which permits for installation and/or removal of the stock assembly 100. The steeper lower section 305*b* may necessitate additional linear force to move the panel 135 than the upper section 305*a*, which may provide tactile feedback to the user 505 (i.e., greater resistance) and extra protection from accidental stock removal if the lever 225 is activated.

The stock assembly 100 and the elements of the stock assembly 100 described herein may enable a user or manufacturer to more efficiently align and attach the stock assembly 100 and/or components thereof to the firearm 715 and/or components thereof, such as the receiver extension 710, as compared to traditional means for attaching a stock to a firearm. For example, the stock assembly 100 may be lighter in weight compared to traditional stocks due to the compact nature of the components described herein, which may make it easier to hold and angle onto the receiver extension 710. As depicted in the figures, a user 705 may install the stock assembly 100 by hand, e.g., without tools, which enables more efficient installation and removal processes, for example that may be performed in various user positions such as standing or moving. Additionally, since the stock assembly 100 may include slider panels 135 on each side of the stock assembly 100, and each including the interface 140, the stock assembly 100 enables ambidextrous sliding and movement. Thus, not only may the stock assembly 100 be more easily operated by more users, e.g., right and left-handed users, the stock assembly 100 may be operated by one user in more ways, e.g., a single user may operate each side of the stock assembly 100, which increases the efficiency and frequency that LOP adjustments may be made. Further, since the engagement of the release pin 240 and lower section 305*b* in combination with the biasing force of the biasing mechanism 230 may provide tactile feedback to the user 705, e.g., signal to the user 705 that the lock pin 235 is disengaged from the pocket 720, LOP adjustments may be more efficient than traditional means since the user 705 may spend less time actuating the slider assembly 130. Moreover, due to the biasing mechanism 230 and lock pin 235 engagement, the LOP adjustments may be more precise than traditional means because the user 705 may quickly adjust the stock assembly 100 to the desired position or length and the biasing mechanism 230 may rapidly reposition the lock pin 235 within a pocket 720, e.g., prior to the stock assembly 100 sliding or moving away from the position desired by the user 705.

The examples of the stock assembly 100 described herein allows the main spring driving the locking mechanism in the prior art to be removed from the limited space within the hollow lock pin and placed in a more advantageous region of the stock. This allows for a simpler lock pin having a solid structure and more latitude to optimize spring design for parameters such as force and stress. The rearward motion, as compared to a downward motion typically seen in the art, is similar to a trigger motion and since the pulling motion is often in the same direction as the desired movement of the stock assembly, e.g., proximal, this action is inherently more intuitive to a user. Additionally, as a translating mechanism, the user does not need to concern themselves as much with finger placement to get the proper leverage to adjust the stock as compared to previous lever designs.

FIGS. 8A-B depict examples of the sling 815 coupled with the stock assembly 100. For example, the stock assembly 100 may include the sling 815. The slot 125 defined by the lower stock assembly 110 may have an elongated shape, such as a rectangular shape with rounded corners. The elongated shape of the slot 125 may enable various ways to mount the sling 815. For example, the shape of the slot 125 may correspond to, e.g., be shaped to align or couple with, the shape of various firearm accessories, such as the sling 815 and/or the sling mount 805. For example, the stock assembly 100 may include the sling mount 805, as depicted in FIG. 8A. The sling mount 805 may be permanently mounted or removably coupled with the slot 125. For example, the sling mount 805 may couple with the slot 125 via a push-button attachment, e.g., the slot 125 and/or the sling mount 805 may include ridges or beveled edges that may align with each other such that the sling mount 805 may be "snapped" into the slot 125; a magnetic attachment, e.g., the sling mount 805 may include two pieces that are attracted to each other through the slot 125; or the like. In this example, the sling 815 may be coupled with the sling mount 805 and thus indirectly coupled with the slot 125. In other examples, the sling 815 may be directly coupled with the slot 125. For example, as depicted in FIG. 8B, the sling 815 may be coupled with the slot 125 via a footman's loop 810.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A buttstock comprising:

a proximal end configured to contact a user object and a distal end configured to slidably couple with a receiver extension, wherein an internal cavity of the buttstock is defined between the proximal end and the distal end;

a first slider panel defining a channel;

a second slider panel coupled with the first slider panel by a fastener extending through the internal cavity of the buttstock, wherein the first slider panel and the second slider panel are configured to travel along a horizontal track defined by a body of the buttstock;

a biasing mechanism disposed in the internal cavity, the biasing mechanism configured to bias the first slider panel toward the distal end of the buttstock;

a lock pin disposed in the internal cavity and configured to contact the biasing mechanism, wherein a longitudinal axis of the lock pin is substantially orthogonal to a longitudinal axis of the biasing mechanism; and a release pin extending through the lock pin, wherein a longitudinal axis of the release pin is substantially orthogonal to the longitudinal axis of the lock pin and substantially orthogonal to the longitudinal axis of the biasing mechanism;

wherein:

an end portion of the release pin extends into the channel;

the release pin is configured to travel along a path defined by the channel in response to a movement of the first slider panel; and the release pin is configured to cause the lock pin to transition from a first position to a second position in response to the movement.

2. The buttstock of claim 1, wherein:

the first slider panel comprises an interface between the proximal end and the distal end of the buttstock; and the movement of the first slider panel is caused by user engagement with the interface.

3. The buttstock of claim 2, wherein:

the movement of the first slider panel is toward the proximal end of the buttstock;

with the lock pin in the first position, the release pin extends into an upper portion of the channel; and with the lock pin in the second position, the release pin extends into a lower portion of the channel.

4. The buttstock of claim 3, wherein:

with the lock pin in the first position, a portion of the lock pin is configured to extend into a pocket defined by the receiver extension;

with the lock pin in the second position, the portion of the lock pin is configured to not extend into the pocket of the receiver extension; and with the lock pin in the second position, the buttstock is configured to slide along a length of the receiver extension.

5. The buttstock of claim 1, wherein:

the movement of the first slider panel is caused by the biasing mechanism;

the movement of the first slider panel is toward the distal end of the buttstock;

with the lock pin in the first position, the release pin extends into a lower portion of the channel; and with the lock pin in the second position, the release pin extends into an upper portion of the channel.

6. The buttstock of claim 5, wherein:

with the lock pin in the first position, a portion of the lock pin is configured to not extend into a pocket defined by the receiver extension;

with the lock pin in the second position, the portion of the lock pin is configured to extend into the pocket of the receiver extension; and with the lock pin in the second position, the buttstock is inhibited from sliding along a length of the receiver extension.

7. The buttstock of claim 1, further comprising:

a lever configured to inhibit the movement of the first slider panel, wherein the movement is toward the proximal end of the buttstock.

8. The buttstock of claim 1, further comprising:

a lever configured to transition between a locked position and an unlocked position, wherein with the lever in the locked position, the lever is configured to inhibit the movement of the first slider panel and lock a portion of the lock pin in a pocket defined by the receiver extension; and an icon configured to signal whether the lever is in the locked position or the unlocked position.

9. A stock assembly comprising:

a stock body defining an internal cavity between a proximal end and a distal end of the stock body; and a slider assembly comprising:

a first panel having an interior surface and an exterior surface, the interior surface of the first panel partially defining the internal cavity and defining a first channel;

a second panel having an interior surface and an exterior surface, the interior surface of the second panel partially defining the internal cavity and defining a second channel;

a fastener extending through the internal cavity and coupling the first panel and the second panel together, wherein the first panel and the second panel are each configured to move together along a track defined by the stock body;

a lock pin disposed in the internal cavity; and a release pin extending through the lock pin and having a first end portion extending into the first channel and a second end portion extending into the second channel;

wherein:

the release pin is configured to travel along a fixed path defined by the first channel and the second channel in response to a movement of the first panel and the second panel along the track; and the release pin is configured to cause the lock pin to transition from a first position to a second position in response to the movement; and a lever configured to transition between a locked position and an unlocked position, wherein with the lever in the locked position, the lever is configured to inhibit the movement of the first panel and lock a portion of the lock pin in a pocket defined by a receiver extension.

10. The stock assembly of claim 9, further comprising:

a biasing mechanism disposed in the internal cavity, the biasing mechanism configured to contact the lock pin and configured to bias the first panel and the second panel toward the distal end of the stock body.

11. The stock assembly of claim 10, wherein:

the movement of the first panel and the second panel is caused by the biasing mechanism;

the movement of the first panel and the second panel is toward the distal end of the stock body;

with the lock pin in the first position, the first end portion of the release pin extends into a lower portion of the first channel and the second end portion of the release pin extends into a lower portion of the second channel; and with the lock pin in the second position, the first end portion of the release pin extends into an upper portion of the first channel and the second end portion of the release pin extends into an upper portion of the second channel.

12. The stock assembly of claim 9, wherein:

with the lock pin in the second position, the portion of the lock pin is configured to extend into the pocket of the receiver extension and inhibit the stock body from sliding along a length of the receiver extension.

13. The stock assembly of claim 9, wherein:

the first panel and the second panel each comprise an interface disposed on the exterior surfaces of the first panel and the second panel, respectively;

the movement of the first panel and the second panel is caused by user engagement with at least one of the interface of the first panel or the interface of the second panel;

the movement of the first panel and the second panel is toward the proximal end of the stock body;

with the lock pin in the first position, the first end portion of the release pin extends into an upper portion of the first channel and the second end portion of the release pin extends into an upper portion of the second channel; and with the lock pin in the second position, the first end portion of the release pin extends into a lower portion of the first channel and the second end portion of the release pin extends into a lower portion of the second channel.

14. The stock assembly of claim 13, wherein:

with the lock pin in the first position, a portion of the lock pin is configured to extend into the pocket defined by the receiver extension;

with the lock pin in the second position, the portion of the lock pin is configured to not extend into the pocket of the receiver extension; and with the lock pin in the second position, the stock body is configured to slide along a length of the receiver extension.

15. The stock assembly of claim 9, wherein:

the first panel and the second panel each comprise an interface disposed on the exterior surfaces of the first panel and the second panel, respectively; and the interfaces each extend outward from the exterior surfaces of the first panel and the second panel.

16. The stock assembly of claim 9, wherein:

the lever is configured to inhibit the movement of the first panel and the second panel in a direction toward the proximal end of the stock body.

17. A buttstock comprising:

a slider panel defining a channel;

a biasing mechanism disposed in an internal cavity defined by the buttstock, the biasing mechanism configured to bias the slider panel toward a distal end of the buttstock;

a lock pin disposed in the internal cavity;

a release pin affixed within the lock pin and having an end portion extending into the channel, wherein the release pin is configured to translate longitudinal motion of the slider panel to perpendicular motion of the lock pin; and a lever configured to transition between a first state and a second state;

wherein:

with the lever in the first state, the lever is arranged to inhibit retraction of the slider panel toward a proximal end of the buttstock and lock a portion of the lock pin in a pocket defined by a receiver extension; and with the lever in the second state, the lever is arranged to permit retraction of the slider panel toward the proximal end of the buttstock.

18. The buttstock of claim 17, wherein the lever comprises an integral spring and a detent.

19. The buttstock of claim 18, wherein the integral spring and the detent are formed from a cantilevered arm configured to interface with an interior surface of the buttstock.

20. The buttstock of claim 17, wherein:

the lock pin is configured to contact the biasing mechanism, a longitudinal axis of the lock pin is substantially orthogonal to a longitudinal axis of the biasing mechanism.

* * * * *